US009646578B2

(12) United States Patent
Takata et al.

(10) Patent No.: US 9,646,578 B2
(45) Date of Patent: May 9, 2017

(54) KEYBOARD DEVICE

(71) Applicant: ROLAND CORPORATION, Shizuoka (JP)

(72) Inventors: Yukihide Takata, Shizuoka (JP); Yukihiro Morohashi, Shizuoka (JP); Shiro Uno, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 199 days.

(21) Appl. No.: 14/526,516

(22) Filed: Oct. 29, 2014

(65) Prior Publication Data

US 2015/0122108 A1 May 7, 2015

(30) Foreign Application Priority Data

Nov. 1, 2013 (JP) ..... 2013-228774
Mar. 28, 2014 (JP) ..... 2014-069931

(51) Int. Cl.
*G10C 3/12* (2006.01)
*G10H 1/34* (2006.01)

(52) U.S. Cl.
CPC ..... *G10C 3/125* (2013.01); *G10H 1/346* (2013.01)

(58) Field of Classification Search
CPC ..... G10C 3/12; G10C 3/125; G10H 1/346; B32B 21/042; B32B 2260/026
USPC ..... 84/423 R, 433, 438, 452 R, 452 P
See application file for complete search history.

(56) References Cited

U.S. PATENT DOCUMENTS

2005/0145093 A1* 7/2005 Nishida ..... G10C 3/12 84/433

FOREIGN PATENT DOCUMENTS

JP 2000-020052 1/2000
JP 2009169083 A * 7/2009 ..... G10C 3/12
JP 2009-229515 10/2009

* cited by examiner

*Primary Examiner* — Kimberly Lockett
(74) *Attorney, Agent, or Firm* — Jianq Chyun IP Office

(57) ABSTRACT

A keyboard device has a plurality of keys, wherein each key includes: a base member formed of a resin material in a box shape having an open lower surface opposite a touching surface, the base member having a rotatably supported base end side; and a pair of wood members formed of a wood material in a rectangular plate shape, disposed respectively on left and right side surfaces of the base member, wherein at least one of the pair of wood members has a thickness dimension within a range of 2 mm or more and 14.5 mm or less.

29 Claims, 15 Drawing Sheets

KEYBOARD DEVICE

CROSS-REFERENCE TO RELATED APPLICATIONS

This application claims the priority benefit of Japan application serial no. 2013-228774, filed Nov. 1, 2013 and the priority benefit of Japan application serial no. 2014-069931, filed Mar. 28, 2014. The entirety of each of the above-mentioned patent applications is hereby incorporated by reference herein and made a part of this specification.

BACKGROUND OF THE INVENTION

Field of the Invention

The present invention relates to a keyboard device, and more particularly, to a keyboard device capable of preventing occurrence of unpleasant noise when a touching surface of a key is touched by a player's fingernail.

Description of Related Art

Conventionally, there has been known a keyboard device with keys made of a wood material (e.g., spruce) while the keyboard device is for use in an electronic keyboard instrument such as an electronic piano (Patent Literature 1). However, as in this case, if the keys are formed of a wood material, the keyboard device is increased in both weight and product cost.

With respect to this, a keyboard device has been proposed (Patent Literature 2) in which a base material (base member) of a key is formed of a resin material, and a wood portion (wood member) formed of a wood material is disposed on left and right side surfaces of the base material, so as to provide the key with a feel of wood while reducing the weight and product cost of the keyboard device.

PRIOR-ART DOCUMENTS

Patent Literature

Patent Literature 1: Japanese Patent Publication No. 2000-020052 (Paragraph [0003], etc.)

Patent Literature 2: Japanese Patent Publication No. 2009-229515 (Paragraph [0005], FIG. 2, etc.)

SUMMARY OF THE INVENTION

Problems to be Solved by the Invention

Nevertheless, in the keyboard device disclosed in the above Patent Literature 2, in order to ensure reduction in product weight and formability of the base material, the base material is formed in a box shape having an open lower surface opposite a touching surface. Consequently, a large cavity is formed inside the base material, and a problem has arisen in that when the touching surface of the key is touched by a player's fingernail, the cavity resonates to produce unpleasant noise.

The present invention has been accomplished in order to solve the above problem, and is intended to provide a keyboard device capable of preventing occurrence of the unpleasant noise when the touching surface of the key is touched by the player's fingernail.

Solution to the Problems and Effect of the Invention

According to a keyboard device of the first technical solution, at least one of a pair of wood members has a thickness dimension set to 2 mm or more. Accordingly, a cavity of a base member formed in a box shape having an open lower surface can be reduced in volume. As a result, when a touching surface is touched by a player's fingernail, the cavity becomes less likely to resonate and occurrence of unpleasant noise can be prevented.

Meanwhile, the thickness dimension of the at least one of the pair of wood members is set to 14.5 mm or less. Thus, a wood material heavier than a resin material is used in reduced amount, and weight reduction of the product as a whole can be achieved. In addition, since the cavity of the base member can be prevented from becoming too small, in a mechanism that guides rotation of a key by a guide post inserted into the cavity of the base member, rigidity of the guide post can be ensured.

Moreover, one and the other of the pair of wood members may each have a thickness dimension within a range of 2 mm or more and 14.5 mm or less.

According to a keyboard device of the second technical solution, in addition to the effect of the keyboard device of the first technical solution, warpage of the key as a whole can be prevented.

That is, when warpage occurs in the pair of wood members made of a wood material, such warpage of the wood member occurs in greater degree in the wood member having a long longitudinal dimension than in the wood member having a short longitudinal dimension. Hence, when the pair of wood members having different longitudinal dimensions is disposed respectively on left and right side surfaces of the base member, under influence of the warpage of the wood member having a long longitudinal dimension, warpage occurs in the key as a whole. With respect to this, according to the second technical solution, the wood member having a short longitudinal dimension has a thickness dimension greater than a thickness dimension of the wood member having a long longitudinal dimension. Accordingly, the influence of the warpage of the wood member having a long longitudinal dimension is reduced, so that the warpage of the key as a whole can be prevented.

According to a keyboard device of the third technical solution, in addition to the effect of the keyboard device of the first technical solution, the pair of wood members is disposed respectively on left and right side surfaces of a narrow-width portion of the base member, and thickness dimensions of the pair of wood members disposed on the left and right side surfaces of the narrow-width portion are set substantially the same. Thus, rigidity of the narrow-width portion of the key is made equal on the left and right sides, and the key can be prevented from bending in a twisted manner when strongly tapped. As a result, interference with adjacent keys is suppressed, and shaking of the key during a performance can be prevented. In addition, since the thickness dimensions of the pair of wood members disposed on the left and right side surfaces of the narrow-width portion are set substantially the same, compared to a case where the wood member is disposed only on either of the left and right side surfaces of the narrow-width portion, influence of the warpage of the wood members is reduced and the warpage of the key as a whole can be prevented.

According to a keyboard device of the fourth technical solution, in addition to the effect of the keyboard device of the first technical solution, the pair of wood members is disposed respectively on the left and right side surfaces of the base member with wood rear sides or wood surface sides of the pair of wood members facing each other. Thus, the pair of wood members warps in opposite directions so that the warpage can be canceled out. As a result, the warpage of the key as a whole can be prevented.

According to a keyboard device of the fifth technical solution, in addition to the effect of the keyboard device of the first technical solution, a concave groove is depressed in the left and right side surfaces of the base member in a region including at least one of four sides corresponding to an outer edge of an inside surface of the wood members. Thus, if a burr (projected portion protruding from a corner of the pair of wood member caused by a cutting process) occurs at the outer edge of the inside surface of the pair of wood members, the burr can be accommodated in the concave groove so that the inside surface of the pair of wood members can be easily tightly stuck to the left and right side surfaces of the base member. As a result, formation of a clearance or a gap between the base member and the pair of wood members can be prevented.

In addition, if the pair of wood members is adhesively fixed to the left and right side surfaces of the base member by means of an adhesive, the adhesive flowing from adhered surfaces of both members can be accommodated in the concave groove. Thus, a step of wiping to remove the extending adhesive can be omitted.

According to a keyboard device of the sixth technical solution, in addition to the effect of the keyboard device of the fifth technical solution, the concave groove of the base member is depressed in a region that includes one of the four sides corresponding to the outer edge of the inside surface of the pair of wood members, the one side being located on the touching surface side of the base member. Thus, the burr can be accommodated in the concave groove on the touching surface side of the base member. As a result, the pair of wood members can be prevented from protruding more than left and right end surfaces of the touching surface of the base member, thereby a gap can be reduced, and a finger can be prevented from being caught by the gap when pressing adjacent keys. In addition, formation of a clearance between the left and right end surfaces of the touching surface of the base member and the pair of wood members is prevented, and the appearance can be prevented from being spoiled.

In addition, the concave groove is depressed in a region that includes one of the four sides corresponding to the outer edge of the inside surface of the pair of wood members, the one side being located on a front side of the base member. Thus, the burr can be accommodated in the concave groove on the front side of the base member. As a result, formation of a clearance between left and right end surfaces of the front side of the base member and the pair of wood members is prevented, and the appearance can be prevented from being spoiled.

According to a keyboard device of the seventh technical solution, in addition to the effect of the keyboard device of the sixth technical solution, the concave groove of the base member is depressed in at least one of: a region that includes the side that is located on the touching surface side of the base member among the four sides corresponding to the outer edge of the inside surface of the pair of wood members, and the region that includes the side that is located on the front side of the base member among the four sides corresponding to the outer edge of the inside surface of the pair of wood members. Also, the concave groove extends across the outer edge of the pair of wood members. Thus, a more uniform thickness dimension is achieved on an upper surface (touching surface) or a front surface of the base member, so that occurrence of a sink mark during molding can be prevented. As a result, the appearance can be prevented from being spoiled.

According to a keyboard device of the eighth technical solution, in addition to the effect of the keyboard device of the first technical solution, the base member includes side plates that form the left and right side surfaces, and a through hole is formed in the side plates where the pair of wood members is disposed. Thus, if the pair of wood members is adhesively fixed to the left and right side surfaces of the base member by means of an adhesive, the adhesive interposed between adhered surfaces of both members flows into the through hole and flows out oppositely (goes round to a surface on the opposite side). Accordingly, the adhesive that has gone round to the surface on the opposite side exhibits an anchor effect, so that an adhesive strength can be improved. In addition, through visual recognition of an outflow state of the adhesive flowing from the opening on the opposite side, an applying state of the adhesive can be confirmed.

According to a keyboard device of the ninth technical solution, in addition to the effect of the keyboard device of the first technical solution, a plurality of through holes are formed through a region in the left and right side surfaces where the pair of wood members is disposed, and the plurality of through holes are disposed at different positions in a longitudinal direction of the base member. Thus, for example, it is easy to discover if a portion is not applied with the adhesive.

According to a keyboard device of the tenth technical solution, in addition to the effect of the keyboard device of the first technical solution, a chamfered portion is formed on at least one of four sides of an outer edge of an inside surface of the pair of wood members by a chamfering process. Thus, occurrence of a burr at the outer edge of the inside surface of the pair of wood members is prevented, so that the inside surface of the pair of wood members can be easily tightly stuck to the left and right side surfaces of the base member. As a result, formation of a clearance or a gap between the base member and the pair of wood members can be prevented.

In addition, if the pair of wood members is adhesively fixed to the left and right side surfaces of the base member by means of an adhesive, the adhesive flowing from adhered surfaces of both members can be accommodated in a space between the left and right side surfaces of the base member and the chamfered portion. Thus, a step of wiping to remove the extending adhesive can be omitted.

According to a keyboard device of the eleventh technical solution, in addition to the effect of the keyboard device of the tenth technical solution, the chamfered portion is formed on one of the four sides of the outer edge of the inside surface of the pair of wood members, the one side being corresponding to the touching surface side of the base member. Thus, the burr can be prevented from being interposed between the base member and the pair of wood members on the touching surface side of the base member. As a result, the pair of wood members can be prevented from protruding more than left and right end surfaces of the touching surface of the base member, thereby a gap can be reduced, and a finger can be prevented from being caught by the gap when pressing adjacent keys. In addition, formation of a clearance between the left and right end surfaces of the touching surface of the base member and the pair of wood members is prevented, and the appearance can be prevented from being spoiled.

In addition, the chamfered portion is formed on one of the four sides of the outer edge of the inside surface of the pair of wood members, the one side being corresponding to a front side of the base member. Thus, the burr can be prevented from being interposed between the base member and the pair of wood members on the front side of the base member. As a result, formation of a clearance between the left and right end surfaces of the front side of the base member and the pair of wood members is prevented, and the appearance can be prevented from being spoiled.

According to a keyboard device of the twelfth technical solution, in addition to the effect of the keyboard device of the first technical solution, if an outside surface of the pair of wood members is disposed flush with or more inward and backward than left and right end surfaces of the touching surface of the base member, a gap between the outside surface of the pair of wood members and the left and right end surfaces of the touching surface of the base member is within a range of 0 mm or more and 0.2 mm or less. Thus, a sense of unity is achieved between the base member and the pair of wood members so as to improve the appearance, and meanwhile, a finger can be prevented from being caught by the gap when pressing or releasing adjacent keys.

According to a keyboard device of the thirteenth technical solution, in addition to the effect of the keyboard device of the twelfth technical solution, a portion of the base member disposed lower than the pair of wood members is disposed more inward and backward than the outside surface of the pair of wood members. Thus, when a cutting process is performed on left and right side surfaces of a white key, a region of the base member to be subjected to the cutting process simultaneously with the pair of wood members is limited to the minimum, so that damage to such base member can be reduced.

According to a keyboard device of the fourteenth technical solution, in addition to the effect of the keyboard device of the first technical solution, rigidity of the key as a whole can be improved.

Here, in a first group of the keys, one of the pair of wood members having a long longitudinal dimension is disposed on a wide-width portion and a narrow-width portion of the base member. Namely, one of the pair of the wood members is disposed across a total length of the base member. Therefore, the rigidity of the entire key can be ensured. On the other hand, in a second group of the keys, the other of the pair of wood members having a short longitudinal dimension is disposed only on the wide-width portion of the base member, and no wood member is disposed on the narrow-width portion of the base member. Therefore, rigidity of the narrow-width portion of the base member is low, and the rigidity of the key as a whole is lowered.

With respect to this, in the fourteenth technical solution, in at least the second group of the keys, a rigid member formed of a material having higher rigidity than the base member is disposed across a boundary between the wide-width portion and the narrow-width portion of the base member along a longitudinal direction of the base member. Thus, stress at the boundary (i.e., portion where stress easily concentrates) between the wide-width portion and the narrow-width portion of such base member can be effectively dispersed throughout the key via the rigid member. As a result, deformation of or damage to the base member when the key is strongly tapped can be suppressed.

According to a keyboard device of the fifteenth technical solution, in addition to the effect of the keyboard device of the fourteenth technical solution, one end of the rigid member overlaps at least a portion of the pair of wood members disposed on the wide-width portion of the base member as viewed in a left-right direction of the base member among directions orthogonal to the longitudinal direction of the base member. Thus, deformation of or damage to the base member when the key is strongly tapped can be suppressed. That is, because the pair of wood members and the rigid member have higher rigidity than the base member, if a region with no overlap between the pair of wood members and the rigid member is present as viewed in a direction (left-right direction or up-down direction) orthogonal to the longitudinal direction of the base member, stress concentrates at such region, and the base member becomes prone to deformation or damage. With respect to this, in the fifteenth technical solution, since the wood members and the rigid member overlap as viewed in the direction (left-right direction) orthogonal to the longitudinal direction of the base member, the stress can be dispersed throughout the key via the pair of wood members and the rigid member. As a result, deformation of or damage to the base member when the key is strongly tapped can be suppressed.

According to a keyboard device of the sixteenth technical solution, in addition to the effect of the keyboard device of the fourteenth technical solution, the other end of the rigid member overlaps at least a portion of a hammer engaging portion projected from below the base member as viewed in a direction orthogonal to the longitudinal direction of the base member. Thus, the hammer engaging portion of the base member is capable of effectively dispersing a reaction force received from a hammer during a key-pressing operation throughout the key via the rigid member. As a result, deformation of or damage to the base member when the key is strongly tapped can be suppressed.

Moreover, the rigid member is preferably disposed across the hammer engaging portion. The reason is that, by doing so, the dispersion effect by means of the rigid member can be further improved.

According to a keyboard device of the seventeenth technical solution, in addition to the effect of the keyboard device of the fourteenth technical solution, the rigid member is disposed inside the cavity of the base member formed in the box shape having the open lower surface. Accordingly, the cavity can be reduced in volume. As a result, when the touching surface is touched by the player's fingernail, the cavity becomes less likely to resonate and occurrence of unpleasant noise can be prevented.

Moreover, the expression "disposed inside" herein is satisfied as long as the rigid member is disposed within the cavity of the base member. Therefore, the rigid member may be disposed directly on an inner wall surface that defines the cavity of the base member, or may be disposed on a rib-shaped portion disposed upright from the inner wall surface that defines the cavity of the base member and forming a clearance with the inner wall surface that defines the cavity of the base member.

According to a keyboard device of the eighteenth technical solution, in addition to the effect of the keyboard device of the seventeenth technical solution, the base member includes an upper plate that forms the touching surface, and the rigid member is disposed on a lower surface of the upper plate of the base member. Thus, not only the cavity can be reduced in volume, but also the upper plate (i.e., touching surface) itself of the base member can be improved in rigidity. As a result, when the touching surface is touched by the player's fingernail, occurrence of unpleasant noise can be more effectively prevented.

According to a keyboard device of the nineteenth technical solution, in addition to the effect of the keyboard device of the fourteenth technical solution, the rigid member is formed of a wood material. Thus, not only suppression of deformation of or damage to the base member and reduction in product weight as a whole are both achieved, but also occurrence of unpleasant noise can be more effectively prevented. That is, a wood material has higher rigidity than a resin material while having smaller specific gravity (i.e., larger volume per unit weight) than a metal material. Therefore, since the rigid member is formed of a wood material, due to improvement in rigidity, while deformation of or damage to the base member and occurrence of unpleasant noise are suppressed, reduction in product weight can be achieved. Also, the cavity of the base member can be further reduced in volume, so that occurrence of unpleasant noise caused by resonance can be prevented.

According to a keyboard device of the twentieth technical solution, in addition to the effect of the keyboard device of the nineteenth technical solution, the rigid member is disposed only in the base member in the second group of the keys among the first and second groups of the keys, thereby making the first and second groups of the keys have substantially the same weight. Thus, a uniform operation feeling can be obtained by the player from each key in the first and second groups when the player operates (presses or releases) the keys.

Moreover, making each key have substantially the same weight in such manner was never possible with the conventional product in which the key only includes the base member and the wood member, and is realized for the first time by, as in the twentieth technical solution, disposing the wood member having a long longitudinal dimension and the wood member having a short longitudinal dimension in the first group of the keys while disposing only the wood member having a short longitudinal dimension in the second group of the keys, disposing the rigid member only in the second group of the keys in which the rigid member is formed of a wood material, and making a weight of the wood member having a long longitudinal dimension and a weight of the rigid member canceled out by each other. Accordingly, the effect that a uniform operation feeling is obtained from each key in the first and second groups, which was never achieved with the conventional product, can be achieved.

According to a keyboard device of the twenty-first technical solution, in addition to the effect of the keyboard device of the seventeenth technical solution, the rigid member is formed in a plate shape rectangular in cross section or in a rod shape circular in cross section as cut by a plane orthogonal to a longitudinal direction of the rigid member. Thus, directionality of the rigid member in a circumferential direction can be eliminated. Therefore, workability in disposing the rigid member inside the cavity of the base member can be improved. In addition, since the rigid member itself is simplified in shape, when such rigid member is manufactured, manufacturing costs thereof can be reduced.

According to a keyboard device of the twenty-second technical solution, in addition to the effect of the keyboard device of the fourteenth technical solution, the base member includes an upper plate that forms the touching surface, and the rigid member is formed of a metal material and buried in the upper plate. Thus, the touching surface (upper plate) can be improved in rigidity. As a result, when the touching surface is touched by the player's fingernail, occurrence of unpleasant noise can be prevented.

In addition, according to the twenty-second technical solution, the rigid member can be buried in the upper plate concurrently with a step of molding the base member. Thus, an operation of applying an adhesive for fixing the rigid member to the base member or an operation of disposing the rigid member inside the cavity of the base member is unnecessary. Accordingly, the manufacturing costs can be reduced.

According to a keyboard device of the twenty-third technical solution, in addition to the effect of the keyboard device of the eighteenth technical solution, the base member includes a pair of protruding portions projected from the lower surface of the upper plate and disposed opposed to each other with a predetermined spacing therebetween along the longitudinal direction of the base member, and the rigid member is disposed between the opposed pair of protruding portions. Thus, in the step of disposing the rigid member on the lower surface of the upper plate of the base member, displacement of the rigid member in the longitudinal direction is restricted by the protruding portions, so that positional deviation of the rigid member in the longitudinal direction of the base member can be prevented. Therefore, the rigid member can be disposed at a proper position on the lower surface of the upper plate of the base member.

According to a keyboard device of the twenty-fourth technical solution, in addition to the effect of the keyboard device of the twenty-third technical solution, the pair of protruding portions of the base member is connected to left and right inner wall surfaces that define the cavity of the base member. Thus, if the rigid member is adhesively fixed to the lower surface of the upper plate of the base member by means of an adhesive, the pair of protruding portions can function as walls for preventing an outflow of the adhesive.

According to a keyboard device of the twenty-fifth technical solution, in addition to the effect of the keyboard device of the twenty-third technical solution, at least one of the pair of protruding portions of the base member has a reduced cross-sectional area on a projected leading end side of the at least one of the pair of protruding portions in a cross section cut by a plane orthogonal to a left-right direction of the base member. Thus, when the rigid member is slid on the projected leading end of the protruding portion and disposed on the lower surface of the upper plate of the base member (inserted into the cavity), frictional resistance between the rigid member and the protruding portion can be reduced. Therefore, disposition (insertion) of the rigid member can be smoothly performed.

Moreover, a shape on the projected leading end side having a reduced cross-sectional area is, for example, a shape obtained by curving the projected leading end into an arc shape, or a shape triangular or trapezoidal in cross section tapering toward the projected leading end obtained by formation of an inclined plane.

According to a keyboard device of the twenty-sixth technical solution, in addition to the effect of the keyboard device of the twenty-third technical solution, at least one of the pair of protruding portions of the base member includes an extension portion extending toward the other protruding portion while spaced from the lower surface of the upper plate to allow the rigid member to be interposed therebetween. Thus, by interposing the rigid member between such extension portion and the lower surface of the upper plate, the rigid member can be kept on the lower surface of the upper plate of the base member. Therefore, for example, if the key is strongly tapped during a step of curing the adhesive for adhesively fixing the rigid member to the base member or in a product state, etc., the rigid member can be prevented from falling off from the base member.

According to a keyboard device of the twenty-seventh technical solution, in addition to the effect of the keyboard device of the twenty-third technical solution, at least one of the pair of protruding portions of the base member includes a recess portion formed on a projected leading end of the at least one of the pair of protruding portions, the recess portion being recessed in a V shape as viewed in the longitudinal direction of the base member, the V shape being larger than a width dimension of the rigid member in a left-right direction of the rigid member. Thus, when the rigid member is slid on the recess portion of the protruding portion and disposed on the lower surface of the upper plate of the base member (inserted into the cavity), since only corners of the rigid member contact the recess portion, frictional resistance between the rigid member and the protruding portion can be reduced. Therefore, disposition (insertion) of the rigid member can be smoothly performed. Further, since the contact with the recess portion only occurs at the corners of the rigid member, an adhesive applied on an inside surface of the rigid member can be prevented from being scraped off.

According to a keyboard device of the twenty-eighth technical solution, in addition to the effect of the keyboard device of the twenty-third technical solution, the base member includes opposed walls projected from the lower surface of the upper plate and disposed opposed to each other with a predetermined spacing therebetween along a left-right direction of the base member, wherein the rigid member is disposed between the opposed walls. Thus, in the step of disposing the rigid member on the lower surface of the upper plate of the base member, displacement of the rigid member with respect to the base member in the left-right direction can be restricted by the opposed walls. As a result, the rigid member can be disposed at a proper position with respect to the base member. In addition, in the step of disposing the rigid member on the lower surface of the upper plate of the base member, the disposition operation can be performed by taking the opposed walls as landmarks. Thus, positioning in the left-right direction is made easy and workability thereof can be improved.

According to a keyboard device of the twenty-ninth technical solution, in addition to the effect of the keyboard device of the first technical solution, at least one of left and right side surfaces of a narrow-width portion of the base member extends across a boundary between the narrow-width portion and a wide-width portion, and at least one of the pair of wood members disposed on one of the left and right side surfaces of the narrow-width portion is disposed across the boundary between the narrow-width portion and the wide-width portion. Thus, stress at the boundary (i.e., portion where stress easily concentrates) between the narrow-width portion and the wide-width portion of the base member can be effectively dispersed throughout the key via the wood member. As a result, deformation of or damage to the base member when the key is strongly tapped can be suppressed.

DESCRIPTION OF THE EMBODIMENTS

Figure 1A:
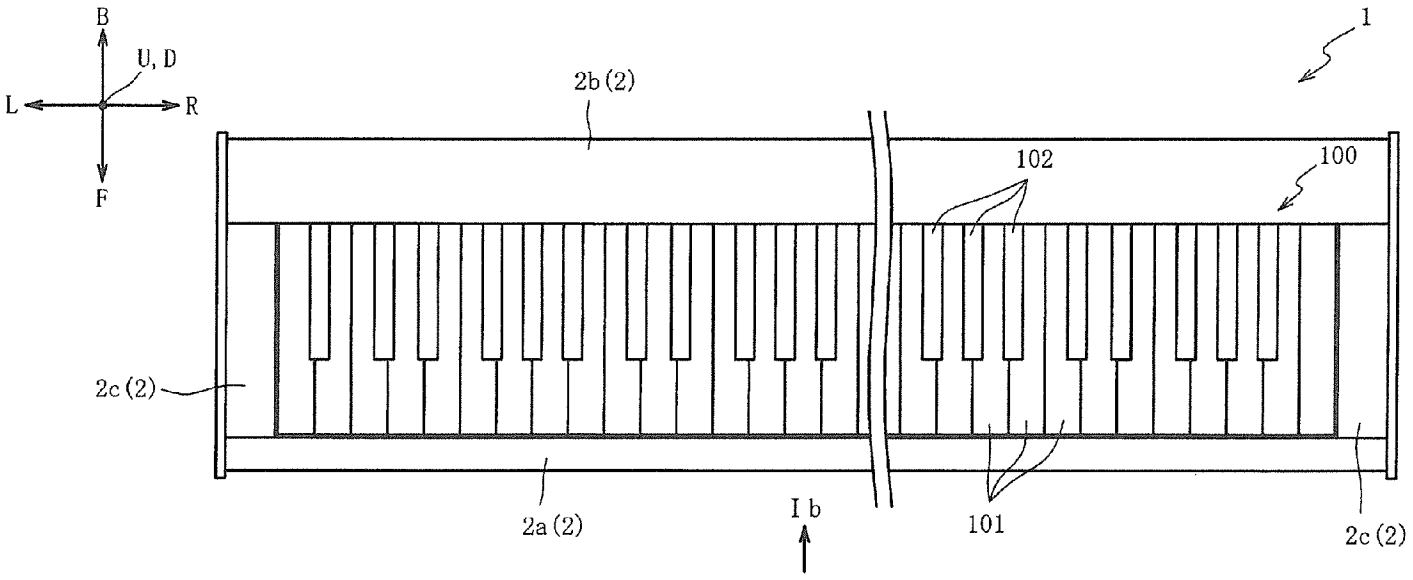
FIG. 1A is a top view of an electronic keyboard instrument having a keyboard device according to the first embodiment installed thereon.
Figure 1B:
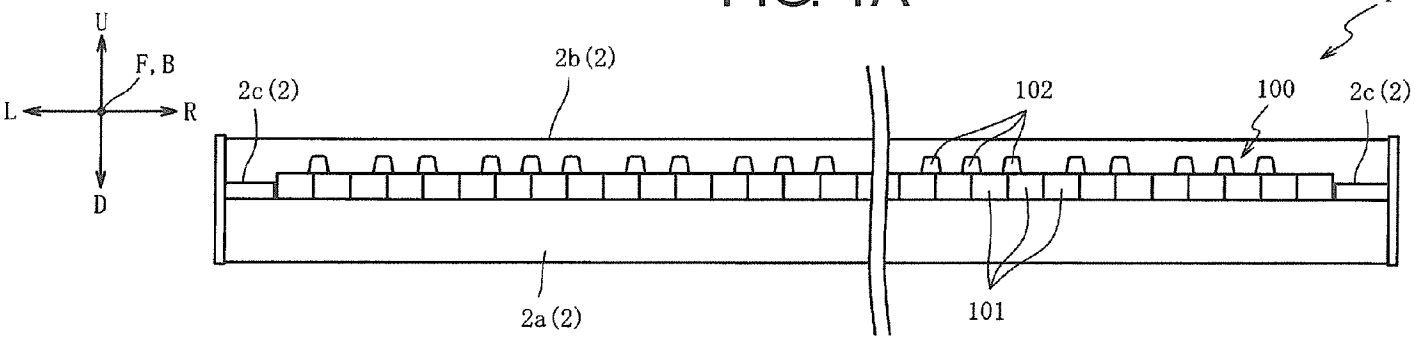
FIG. 1B is a front view of the electronic keyboard instrument as viewed in a direction of an arrow Ib in FIG. 1A.

Preferred embodiments of the present invention are described hereinafter with reference to the accompanying drawings. First, a keyboard device 100 according to the first embodiment of the present invention is described with reference to FIGS. 1A~1B to 8A~8D. FIG. 1A is a top view of an electronic keyboard instrument 1 having the keyboard device 100 according to the first embodiment installed thereon. FIG. 1B is a front view of the electronic keyboard instrument 1 as viewed in the direction of the arrow Ib in FIG. 1A.

Moreover, arrows U-D, L-R and F-B in FIGS. 1A and 1B indicate up-down direction, left-right direction and front-back direction respectively of the electronic keyboard instrument 1. In this case, the left-right direction is defined based on a direction in which a player looks at the electronic keyboard instrument 1, and the front-back direction is defined by taking the player side of the electronic keyboard instrument 1 as the "front (front surface)." The above description also applies to FIG. 2 and subsequent drawings and is thus omitted hereinafter.

As shown in FIG. 1A, the electronic keyboard instrument 1 includes: the keyboard device 100, having a plurality of (e.g., 88) keys (white keys 101 and black keys 102) disposed therein; and a panel portion 2, surrounding the keyboard device 100 and having a frame shape as viewed from above. The panel portion 2 mainly includes: a front panel 2*a* and an upper panel 2*b*, disposed opposed to each other on the front surface (surface on the lower side in FIG. 1A) and a back surface (surface on the upper side in FIG. 1A) respectively of the keyboard device 100; and an end panel 2*c*, connecting end portions of the front panel 2*a* and of the upper panel 2*b* in the left-right direction (direction of the arrow L-R).

An upper surface of the front panel 2*a* and an upper surface of the end panel 2*c* are respectively located between upper surfaces (touching surfaces) and lower ends of the white keys 101 in a height direction (direction of the arrow U-D), as shown in FIG. 1B. Therefore, a portion on the lower end side (lower side in FIG. 1B) of front surfaces of the white keys 101 is covered by the front panel 2*a*, and a portion on the upper surface (touching surface) side of the front surfaces is exposed to be externally visually recognizable.

In addition, among the white keys 101, the white keys 101 adjacent to the end panel 2*c* (i.e., white keys 101 located respectively on left and right ends; later-described white keys 101A' and 101C') have a portion on the lower end side of a side surface that faces the end panel 2*c* covered by the end panel 2*c*, and have a portion on the upper surface (touching surface) side of the side surface that faces the end panel 2*c* exposed to be externally visually recognizable.

On an upper surface (surface on the paper front side in FIG. 1A) of the upper panel 2*b*, a display device including an LED or LCD, etc. for displaying various statuses, and a plurality of manipulators for purposes such as volume adjustment or mode change, for example, are disposed (none of the above is illustrated). In addition, on a back surface of the upper panel 2*b*, a power switch, and a plurality of jacks for inputting and outputting MIDI signals or audio signals, etc., for example, are disposed (none of the above is illustrated).

Figure 2:
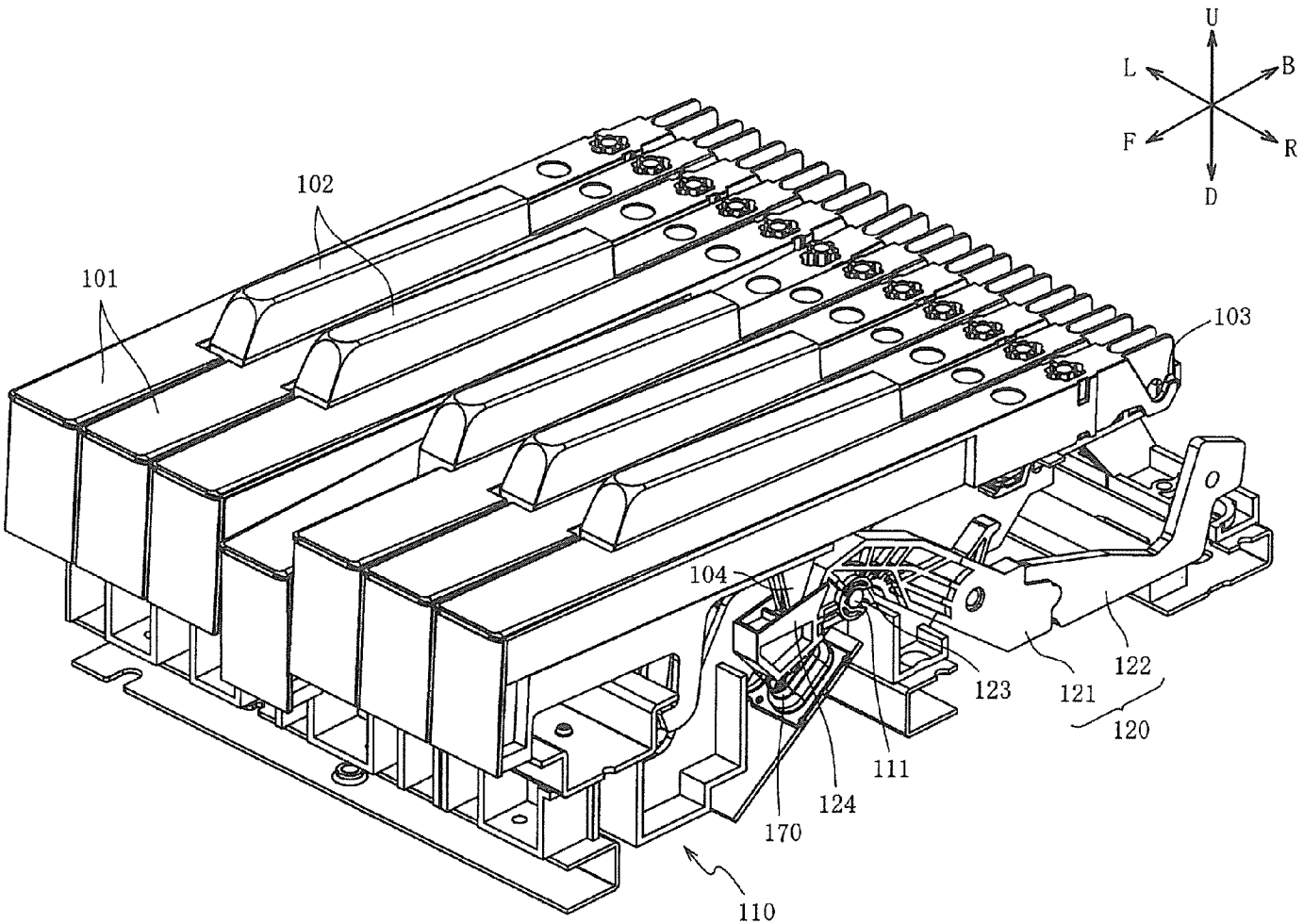
FIG. 2 is a partially enlarged perspective view of the keyboard device.

FIG. 2 is a partially enlarged perspective view of the keyboard device 100 and only partially illustrates a portion corresponding to one octave. Moreover, FIG. 2 illustrates a state that the white key 101 having a pitch name F (later-described white key 101F) is pressed.

As shown in FIG. 2, the keyboard device 100 mainly includes: a chassis 110, formed of a resin material or a steel sheet, etc.; a plurality of keys (the white keys 101 and the black keys 102), having a base end side (right rear side in FIG. 2) rotatably supported by the chassis 110; and a hammer 120, disposed corresponding to each of the white keys 101 and the black keys 102 and rotated along with a key-pressing or key-releasing operation.

The white keys 101 and the black keys 102 are disposed on an upper surface side (upper side in FIG. 2) of the chassis 110, and the hammer 120 is disposed inside the chassis 110 and lined up in the left-right direction (direction of the arrow L-R) of the chassis 110. Moreover, a mechanism that rotatably axially supports (supports) the white keys 101 and the black keys 102 by means of the chassis 110, a mechanism that guides rotation of the white keys 101 and the black keys 102, and a mechanism that rotates the hammer 120 along with pressing or release of the white keys 101 and the black keys 102 are substantially the same between both of the white keys 101 and the black keys 102. Thus, only the mechanisms regarding a white key 101 are described below and descriptions of the mechanisms regarding a black key 102 are omitted.

A key rotating shaft (not illustrated) is formed on a base end side (side of the arrow B) of the chassis 110, and a hammer rotating shaft 111 is formed at a substantially central portion of the chassis 110 in the front-back direction (direction of the arrow F-B). A shaft support hole 103 formed on the base end side of the white key 101 is fitted at the outside of the key rotating shaft, and a shaft support hole 123 formed on a leading end side (side of the arrow F) of the hammer 120 is fitted at the outside of the hammer rotating shaft 111. Accordingly, the white key 101 and the hammer 120 are respectively rotatably axially supported (supported) by the chassis 110.

The hammer 120 is a member for providing the same touch weight as that of an acoustic piano by rotation along with pressing or release of the white key 101. The hammer 120 includes: a hammer body 121, formed of a resin material; and a mass body 122, formed of a metal material and connected to a rear end side (side of the direction of the arrow B) of the hammer body 121 to function as a weight. The mass body 122 of the hammer 120 is located more toward the rear end side than the shaft support hole 123. Thus, the hammer 120 is energized by a deadweight of the mass body 122 in a direction of lifting up a receiving portion 124 formed on the leading end side (side of the direction of the arrow F).

A hammer engaging portion 104 having a substantially tapered shape extending downward (in the direction of the arrow D) from a lower surface side of the white key 101 is formed at a substantially central portion of the white key 101 in a longitudinal direction (direction of the arrow F-B). The hammer engaging portion 104 touches an upper surface of the hammer 120, the upper surface being also an upper surface (i.e., sliding surface of the receiving portion 124) of a portion located more toward the leading end side (direction of the arrow F) than the shaft support hole 123. Accordingly, in a key-pressing operation, the white key 101 is provided with a predetermined touch weight by a mass of the hammer 120; on the other hand, in a key-releasing operation, the white key 101 is lifted up to return to an initial position by the mass of the hammer 120.

Here, specifically, the receiving portion 124 engaged with the hammer engaging portion 104 of the white key 101 is formed into a box shape having an open upper surface by the sliding surface that extends along the front-back direction (direction of the arrow F-B) of the hammer 120 and touches a leading end of the hammer engaging portion 104 and a wall portion disposed upright around the sliding surface. In order to prevent occurrence of wear or noise (scratching noise) when the hammer engaging portion 104 slides on the sliding surface, a viscous material (lubricant such as grease, etc.) is filled in the receiving portion 124.

A key switch 170 is disposed below the chassis 110 at a position more toward the front side (front surface side, side of the arrow F) than the hammer rotating shaft 111. The key switch 170 is a switch for detecting key-pressing information of the white key 101 and is disposed facing a lower surface of the receiving portion 124 of the hammer 120. When the white key 101 is pressed, the leading end side (the receiving portion 124) of the hammer 120 is pushed down, and thereby the key switch 170 is switched on. Based on this ON operation, the pressing of the white key 101 is detected. Moreover, a first switch and a second switch are disposed in the key switch 170. Based on a time difference between the ON operations of the first switch and the second switch, the key-pressing information (velocity) of the white key 101 is detected.

Here, when the white key 101 is pressed, as shown in FIG. 2, a portion of left and right side surfaces of the white keys 101 adjacent to the pressed white key 101 becomes visually recognizable to the player. In this case, according to the keyboard device 100 of the present embodiment, wood members 140S and 140L made of a wood material (spruce in the present embodiment) are disposed on the left and right side surfaces of the white keys 101 as described later, such that the player recognizes that the white keys 101 are made of a wood material except for their touching surfaces and front surfaces. Accordingly, the white keys 101 are provided with a feel of wood, and a luxurious feel can be produced.

Figure 3:
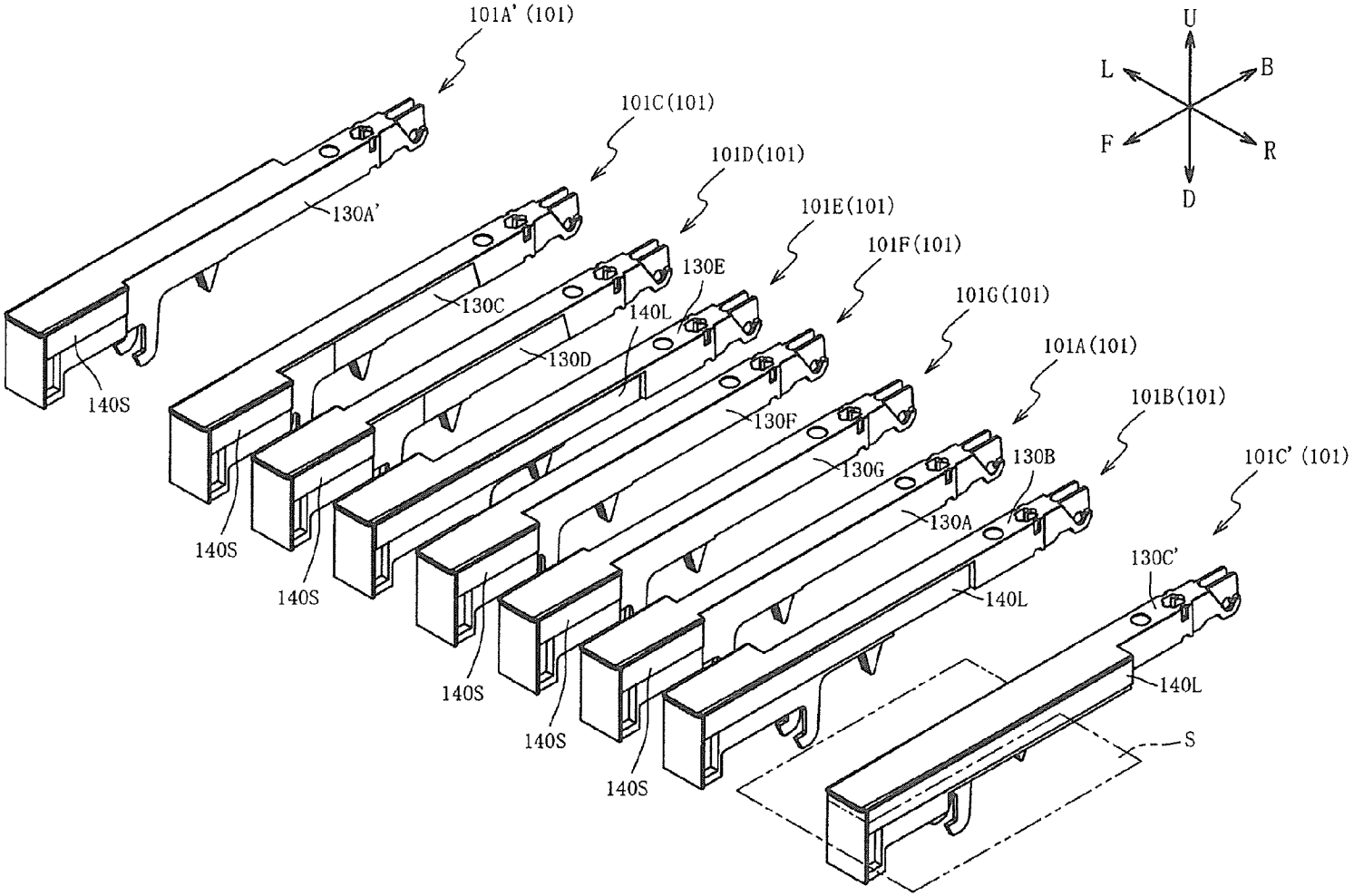
FIG. 3 is a perspective view of white keys.
Figure 4:
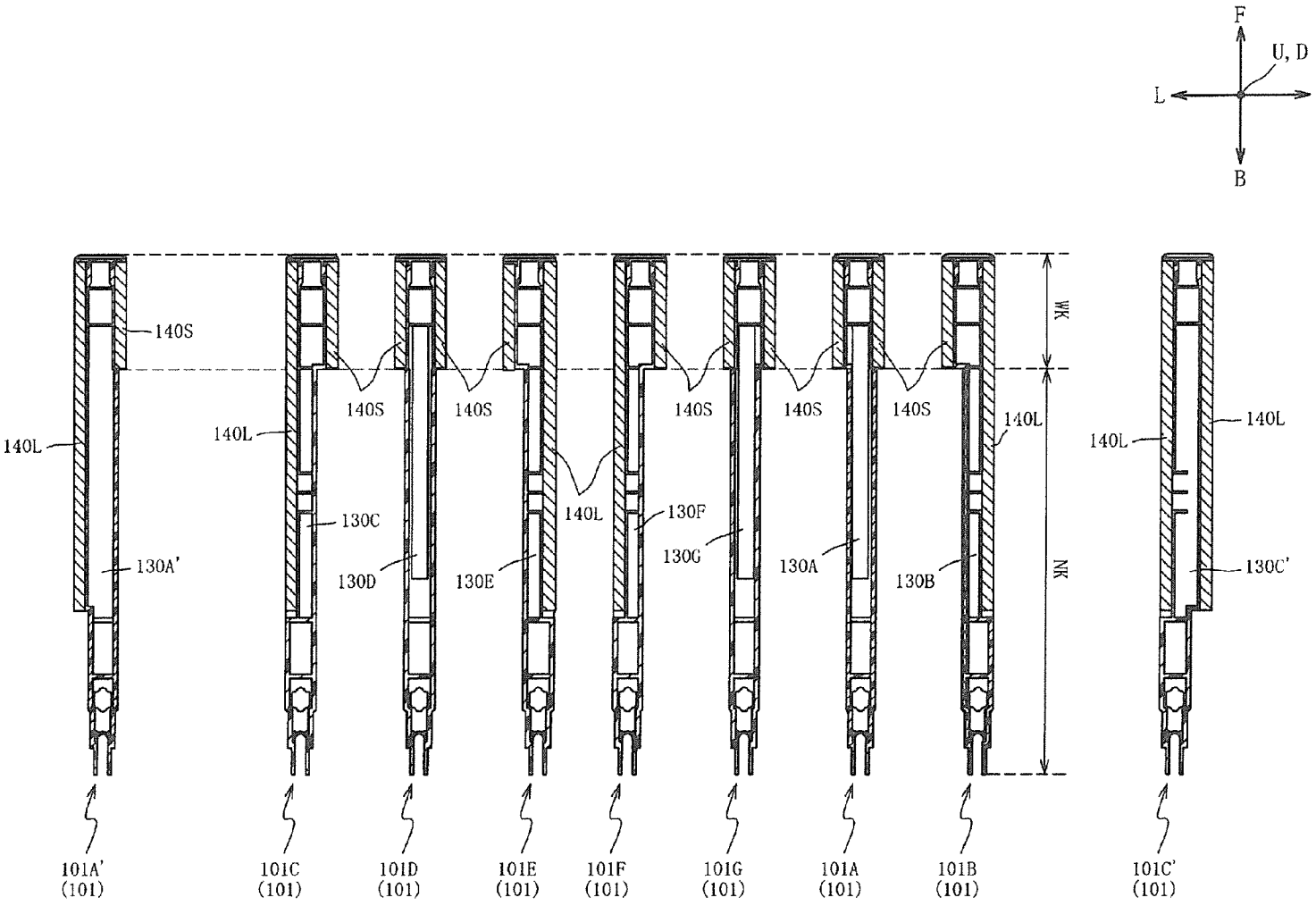
FIG. 4 is a cross-sectional view showing cross sections of the white keys cut by a virtual plane S in FIG. 3 as viewed in a direction of an arrow U.

Next, a schematic configuration of the white keys 101 is described with reference to FIGS. 3 and 4. FIG. 3 is a perspective view of the white keys 101, and FIG. 4 is a cross-sectional view showing the cross sections of the white keys 101 cut by the virtual plane S in FIG. 3 as viewed in the direction of the arrow U.

Moreover, for ease of description, in the following, when a white key 101 is to be specified individually according to a pitch name (C, D, E, . . . ), it is referred to as a reference number (e.g., 101) followed by a corresponding pitch name (e.g., C), such as "white key 101C." In this case, among the plurality of keys, the ones disposed respectively on both ends in the left-right direction (direction of the arrow L-R in FIGS. 1A and 1B) and corresponding to the pitch names A and C are referred to as "white keys 101A' and 101C'."

As shown in FIG. 3, a white key 101 has a gap formed between itself and adjacent white keys 101 for disposition of the black keys 102. According to number and forming positions of the gap, the white keys 101 have nine kinds of shapes. The plurality (88 in the present embodiment) of keys of the keyboard device 100 are constituted by combining the white keys 101 of nine kinds of shapes with the black keys 102 of one kind of shape (see FIGS. 1A and 1B).

Specifically, while the black key 102 is disposed between the white keys 101C and 101D, between the white keys 101D and 101E, between the white keys 101F and 101G, between the white keys 101G and 101A, and between the white keys 101A and 101B, no black key 102 is disposed between the white keys 101E and 101F and between the white keys 101B and 101C (see FIGS. 1A and 1B). Hence, the white keys 101C and 101E, 101F and 101B, and 101G and 101A, respectively, are line-symmetrical as viewed from above with virtual lines along the direction of the arrow F-B as axes of symmetry. The white key 101D is line-symmetrical as viewed from above with its center line as an axis of symmetry.

In addition, while the black key 102 is disposed between the white key 101A' and the white key 101B adjacent thereto, no black key 102 is disposed between the white key 101C' and the white key 101B adjacent thereto. Moreover, the white keys 101A' and 101C' have either of their left and right side surfaces adjacent to the end panel 2*c*. Hence, all of the above white keys 101C to 101B have different shapes. Moreover, the white key 101C' is line-symmetrical with its center line as an axis of symmetry in a key visible range in the top view of the electronic keyboard instrument 1 (see FIG. 1A).

The white keys 101C, 101E, 101F, 101B and 101A' respectively include: base members 130C, 130E, 130F, 130B and 130A' formed of a resin material in a box shape having an open lower surface (on the side of the direction of the arrow D); and wood members 140S and 140L, formed of a wood material in a long plate shape rectangular in cross section, wherein the wood members 140S and 140L are respectively stuck to left and right side surfaces of the base members 130C, 130E, 130F, 130B and 130A'.

The white keys 101D, 101G and 101A respectively include: base members 130D, 130G and 130A, formed of a resin material in a box shape having an open lower surface (on the side of the direction of the arrow D); and the wood member 140S, formed of a wood material in a long plate shape rectangular in cross section, wherein the wood member 140S is stuck to left and right side surfaces of the base members 130D, 130G and 130A.

The white key 101C' includes: a base member 130C', formed of a resin material in a box shape having an open lower surface (on the side of the direction of the arrow D); and the wood member 140L, formed of a wood material in a long plate shape rectangular in cross section, wherein the wood member 140L is stuck to left and right side surfaces of the base member 130C'.

The white keys 101C to 101B and 101A', excluding the white key 101C', have a gap formed between themselves and their adjacent white keys 101 on the base end side (side of the direction of the arrow B) for disposition of the black keys 102. Hence, the base members 130C to 130B and 130A' are formed having two portions: a wide-width portion WK, located on the front side (side of the direction of the arrow F, front surface side); and a narrow-width portion NK, connected to the base end side (side of the direction of the arrow B) of the wide-width portion WK and having a smaller (narrower) dimension in the left-right direction (direction of the arrow L-R) than the wide-width portion WK.

From the above, the white keys 101 are classified according to their shapes into a first group, a second group and a third group. That is, the first group consists of the white keys 101C, 101E, 101F, 101B and 101A' in which the wood member 140L having a long longitudinal dimension is disposed across the wide-width portion WK and the narrow-width portion NK on one of the left and right side surfaces (side surface with no gap formed thereon) of the base members 130C, 130E, 130F, 130B and 130A', and the wood member 140S having a short longitudinal dimension is disposed only on the wide-width portion WK on the other side surface (side surface with a gap formed thereon).

The second group consists of the white keys 101D, 101G and 101A in which the wood member 140S having a short longitudinal dimension is disposed only on the wide-width portion WK on the left and right side surfaces of the base members 130D, 130G and 130A. In addition, the third group consists of the white key 101C' in which the wood member 140L having a long longitudinal dimension is disposed on the left and right side surfaces of the base member 130C'.

Here, the white keys 101 that constitute the same group have substantially the same configuration. Thus, in the following, the white keys 101E and 101D are described as representative examples of the first group and the second group respectively, and descriptions of the other white keys 101 in these groups are omitted.

Figure 5B:
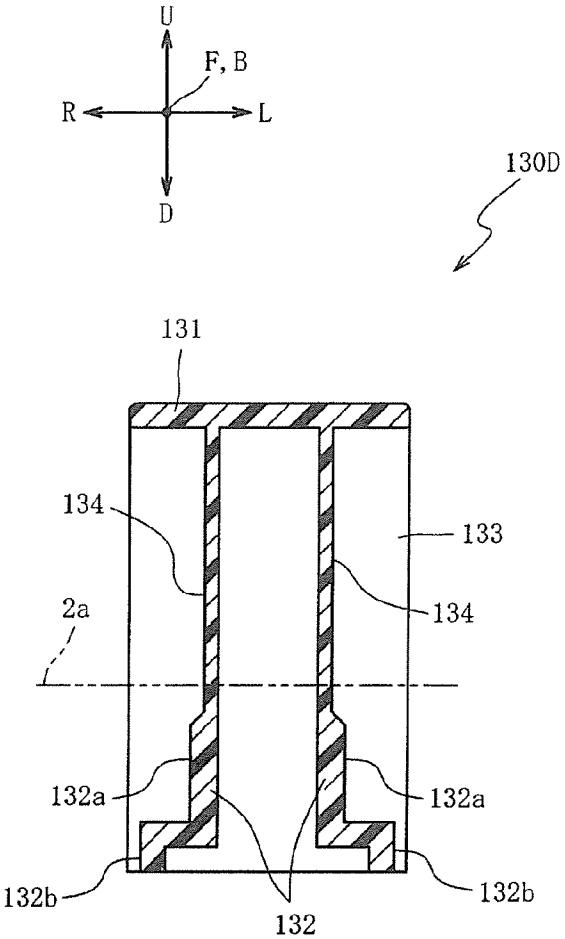
FIG. 5B is a cross-sectional view of the base member taken on line Vb-Vb in FIG. 5A.
Figure 5A:
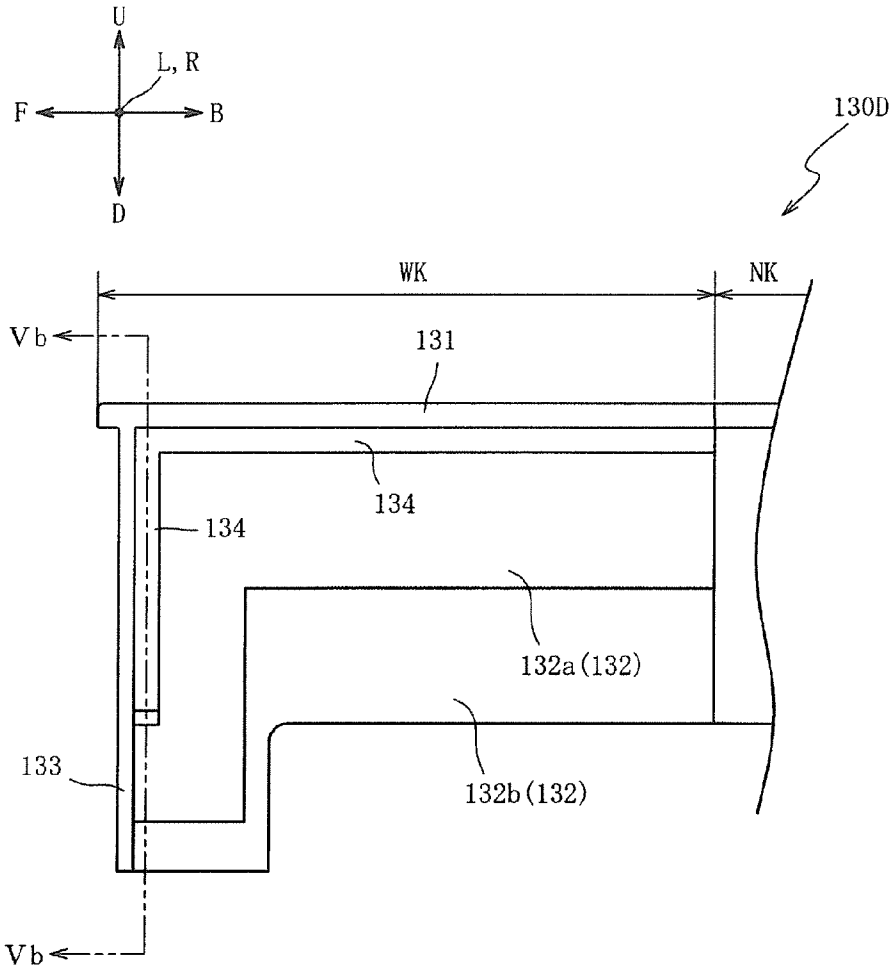
FIG. 5A is a partially enlarged side view of a base member.

Next, the white key 101D as the representative example of the second group is described with reference to FIGS. 5A~5B to 7A~7B. FIG. 5A is a partially enlarged side view of the base member 130D. FIG. 5B is a cross-sectional view of the base member 130D taken on line Vb-Vb in FIG. 5A. Moreover, in FIG. 5B, a position of the upper surface of the front panel 2*a* is schematically illustrated in chain double-dashed lines.

As shown in FIGS. 5A and 5B, the base member 130D mainly includes: an upper plate 131, forming the touching surface on its upper surface (surface on the upper side in FIG. 5B); a pair of side plates 132, extending downward from a lower surface of the upper plate 131 and disposed opposed to each other with a predetermined spacing therebetween in the left-right direction (direction of the arrow L-R); and a front plate 133, connected to end surfaces of the upper plate 131 and the side plate 132 on one end side (left side in FIG. 5A) in the longitudinal direction (direction of the arrow F-B), wherein the plates 131 to 133 are integrally formed of a resin material by injection molding.

A sticking surface 132*a* and an outer shell surface 132*b* are formed on the outside of the side plate 132 (left and right side surfaces of the base member 130D). The sticking surface 132*a* is a flat surface for the wood member 140S to be stuck thereon. As shown in FIG. 5A, the sticking surface 132*a* is formed as an L-shaped region in a side view, connected to the lower surface of the upper plate 131 and a back surface of the front plate 133. The outer shell surface 132*b* is a flat surface formed on a remaining portion (region where no sticking surface 132*a* is formed) other than the sticking surface 132*a* on the outside of the side plate 132. Moreover, the sticking surface 132*a* is located more inward (toward the paper back side in FIG. 5A) and backward than the outer shell surface 132*b*.

Two concave grooves 134 extend linearly along two sides of an outer edge of the sticking surface 132*a*, the two sides being connected respectively to the lower surface (surface on the lower side in FIG. 5A) of the upper plate 131 and the back surface (surface on the right side in FIG. 5A) of the front plate 133. The concave groove 134 is a groove depressed in a concave shape rectangular in cross section. As described later, a space formed by the concave groove 134 receives (provides relief for) a burr protruding from an outer edge (ridge portion) of an inside surface of the wood member 140S, thereby enabling the inside surface of the wood member 140S to be tightly stuck to the sticking surface 132*a* so as to prevent lifting of the wood member 140S.

In addition, the concave groove 134 is depressed along the lower surface of the upper plate 131 and the back surface of the front plate 133. Accordingly, due to the depression of the concave groove 134, a partial increase in thickness dimension (thickening) of connected portions between the upper plate 131 and the side plate 132 and between the front plate 133 and the side plate 132 can be prevented. That is, the connected portions and their proximity are made uniform in thickness dimension, so that occurrence of a sink mark at the upper plate 131 and the front plate 133 during molding can be prevented. As a result, the appearance of the upper surface (touching surface) and the front surface of the white key 101D can be prevented from being spoiled.

Figure 6B:
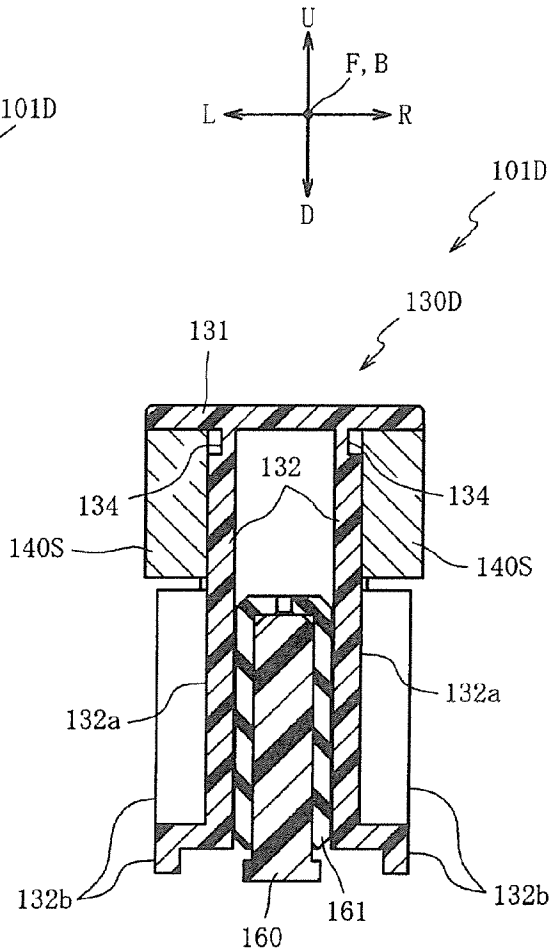
FIG. 6B is a cross-sectional view of the white key taken on line VIb-VIb in FIG. 6A.
Figure 6A:
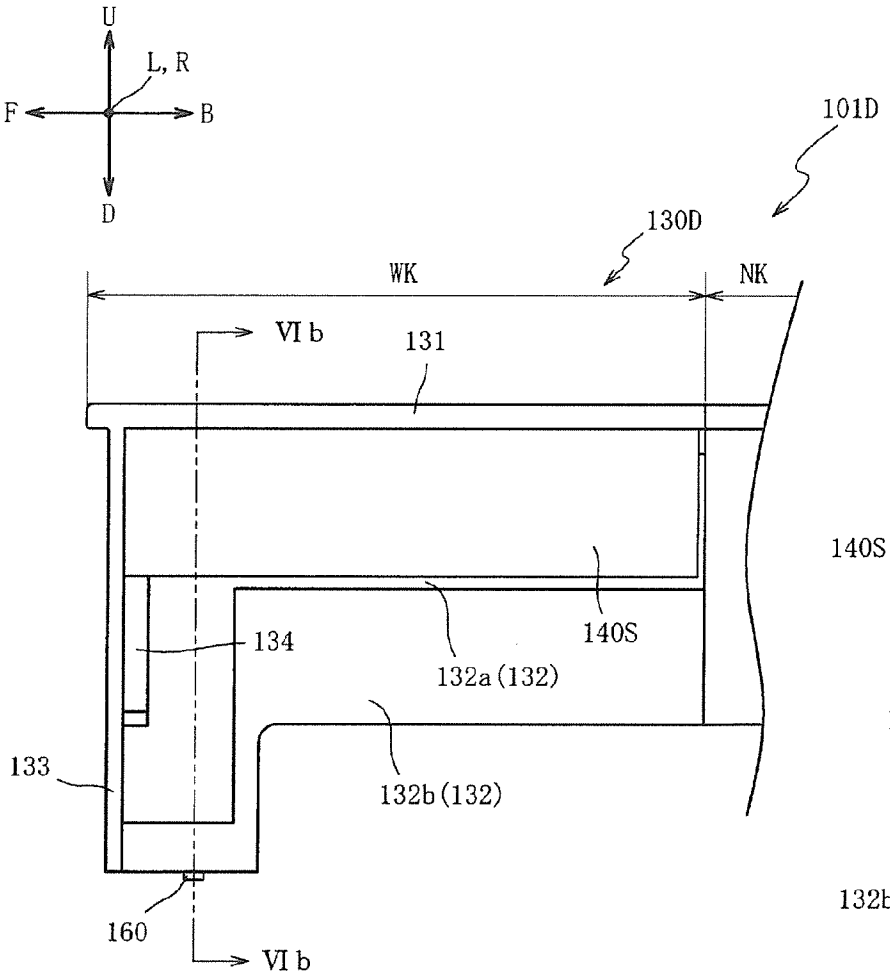
FIG. 6A is a partially enlarged side view of a white key.

Here, among the two concave grooves 134, the concave groove 134 extending along the back surface of the front plate 133 extends downward (in the direction of the arrow D) across the outer edge of the wood member 140S (see FIG. 6A). Accordingly, the front plate 133 as a whole is made uniform in thickness dimension, and occurrence of a sink mark during molding can be prevented. On the other hand, as shown in FIG. 5B, the concave groove 134 extends downward to reach a position a little lower than the upper surface of the front panel 2*a*. Accordingly, in a visually recognizable range of the player (i.e., region exposed above the upper surface of the front panel 2*a*), occurrence of a sink mark on a front surface of the front plate 133 is prevented. Meanwhile, in a visually unrecognizable range of the player (i.e., region covered by the front panel 2*a*), the thickness dimension of the connected portion between the front plate 133 and the side plate 132 is ensured, and rigidity thereof can be improved.

FIG. 6A is a partially enlarged side view of the white key 101D. FIG. 6B is a cross-sectional view of the white key 101D taken on line VIb-VIb in FIG. 6A.

Here, in FIG. 6B, a guide post 160 disposed upright from the upper surface of the chassis 110 (see FIG. 2) is schematically illustrated. The guide post 160 is a portion for guiding rotation of the white key 101D when the white key 101D is rotated about the shaft support hole 103. The guide post 160 is formed of a resin material and having a cylindrical shape, and is inserted into a cavity (i.e., space between the opposed pair of the side plates 132) of the base member 130D.

Moreover, a cover member 161 formed of a rubbery elastic body and having a bottomed cylindrical shape is fitted at the outside of the guide post 160. A plurality of concave grooves (not illustrated) are depressed on the outside of the cover member 161 and formed capable of retaining a viscous material (lubricant such as grease, etc.) filled (applied) in the concave grooves themselves. Accordingly, sliding property between the cover member 161 and the side plate 132 of the base member 130D is improved.

As shown in FIGS. 6A and 6B, the wood member 140S is a member formed of a wood material and formed as a long plate-like body rectangular in cross section. The inside surface of the wood member 140S is adhesively fixed to the sticking surface 132*a* of the side plate 132 of the base member 130D by means of an adhesive, and thereby the wood member 140S is disposed on the left and right side surfaces of the base member 130D.

As described above, the concave groove 134 is depressed in the sticking surface 132*a* of the base member 130D. Thus, even if a burr (projected portion protruding from the outer edge (ridge portion) of the inside surface of the wood member 140S caused by a cutting process) occurs at the outer edge of the inside surface (surface adhesively fixed to the sticking surface 132*a*) of the wood member 140S, the burr is accommodated in the concave groove 134 so that the inside surface of the wood member 140S can be easily tightly stuck to the sticking surface 132*a* of the base member 130D.

Accordingly, lifting of the wood member 140S is prevented, so that formation of a gap between left and right end surfaces (surfaces on the left side or the right side in FIG. 6B) of the upper plate 131 and the front plate 133 and an outside surface (surface adhered to the sticking surface 132*a* and surface on the opposite side) of the wood member 140S can be prevented. As a result, not only the appearance of the white key 101D can be prevented from being spoiled, but also the player's finger can be prevented from being caught by the gap when pressing the white keys 101 adjacent to the white key 101D.

In addition, as in this case, since the concave groove 134 is depressed along the outer edge of the sticking surface 132*a*, the adhesive flowing from between the sticking surface 132*a* of the base member 130D and the inside surface of the wood member 140S (between two adhered surfaces) can be accommodated in the concave groove 134. Thus, a step of wiping to remove the adhesive that extends from boundary portions between the upper plate 131, the front plate 133 and the wood member 140S in the base member 130D to the outside (left and right side surfaces of the white key 101D) can be omitted.

Moreover, as shown in FIG. 6A, the sticking surface 132*a* is larger than the wood member 140S in appearance. Accordingly, even in a region where no concave groove 134 is formed, the adhesive that flows from between the sticking surface 132*a* of the base member 130D and the inside surface of the wood member 140S (between two adhered surfaces) can be prevented from overflowing to the outside surface (surface on the paper front side in FIG. 6A) of the wood member 140S.

Particularly, in the present embodiment, the two concave grooves 134 are depressed along the two sides of the outer edge of the sticking surface 132*a* that are connected respectively to the lower surface of the upper plate 131 and the back surface of the front plate 133 in the base member 130D. Thus, as shown in FIG. 6A, the side surfaces of the wood member 140S can be tightly stuck respectively to the lower surface of the upper plate 131 and to the back surface of the front plate 133. That is, formation of a clearance between the side surface of the wood member 140S and the lower surface of the upper plate 131 and between the side surface of the wood member 140S and the back surface of the front plate 133 is prevented so that the appearance can be prevented from being spoiled. Meanwhile, the concave groove 134 is disposed on only two sides of the outer edge of the sticking surface 132*a*. Since no concave groove 134 is depressed on the remaining two sides of the outer edge, rigidity of the base member 130D can be improved accordingly.

Here, in the present embodiment, the wood member 140S has a thickness dimension (dimension in the direction of the arrow L-R) of 5 mm. If the thickness dimension of the wood member 140S is too small (thin), a distance between the opposed pair of the side plates 132 is increased accordingly and hence the cavity of the base member 130D becomes larger. Therefore, when the touching surface (upper surface of the upper plate 131) is touched by the player's fingernail, the cavity easily resonates to produce unpleasant noise. On the other hand, if the thickness dimension of the wood member 140S is too great (thick), the produce weight is increased accordingly. In addition, since the distance between the opposed pair of the side plates 132 is reduced, it is necessary to make the guide post 160 thinner, and rigidity of the guide post 160 cannot be ensured.

With respect to this, in the present embodiment, the thickness dimension of the wood member 140S is set to 5 mm, and thereby the cavity (volume of the space formed between the opposed pair of the side plates 132) of the base member 130D is made proper. When the touching surface is touched by the player's fingernail, the cavity becomes less likely to resonate and occurrence of unpleasant noise can be prevented. Meanwhile, weight reduction of the product as a whole can be achieved and the rigidity of the guide post 160 can be ensured.

Moreover, a width dimension (thickness dimension, dimension in the direction of the arrow L-R) of the white key 101D is preferably set within a range of 21 to 23 mm (22.5 mm in the present embodiment) in order to be consistent with the width dimension of a white key of an acoustic piano. A wall thickness dimension (thickness dimension) of the base member 130D (the upper plate 131, the side plate 132 and the front plate 133) is preferably set within a range of 1 to 3 mm (2 mm in the present embodiment) in view of balance between securing of rigidity and formability. In this case, in the white key 101D, the thickness dimension of the wood member 140S is preferably set within a range of 2 mm or more and 14.5 mm or less.

That is, in a white key made of a resin material only, if the width dimension of the white key is set to 22.5 mm, by setting the wall thickness dimension of the white key to the maximum value of 3 mm, the width dimension (dimension corresponding to the direction of the arrow L-R) of the cavity becomes the minimum value of 16.5 mm (=22.5 mm−3 mm×2). That is, when the wall thickness dimension of the white key is less (thinner) than 3 mm, the width dimension of the cavity is increased accordingly.

With respect to this, according to the white key 101D, if the width dimension of the white key 101D is set to 22.5 mm, as long as the thickness dimension of the wood member 140S is 2 mm or more, even if the wall thickness dimension of the white key 101D (the upper plate 131, the side plate 132 and the front plate 133) is set to the minimum value of 1 mm, the width dimension (distance between the opposed pair of the side plates 132, dimension in the direction of the arrow L-R) of the cavity can be made 16.5 mm (=22.5 mm−(2 mm+1 mm)×2). As a result, the width dimension of the cavity of the white key 101D can be made equal to or less than the width dimension of the cavity in the white key made of a resin material only.

As long as the thickness dimension of the wood member 140S on one side is 14.5 mm or less, by setting the wall thickness dimension of the white key 101D (the upper plate 131, the side plate 132 and the front plate 133) to the minimum value of 1 mm and the thickness dimension of the wood member 140S on the other side to the minimum value of 2 mm, the width dimension (distance between the opposed pair of the side plates 132, dimension in the direction of the arrow L-R) of the cavity can be made 4 mm (=22.5 mm−(2 mm+14.5 mm)−(1 mm)×2). As a result, the rigidity of the guide post 160 can be ensured.

Moreover, the thickness dimension of the wood member 140S is more preferably set within a range of 4 mm or more and 10.5 mm or less. That is, as long as the thickness dimension of the wood member 140S is 4 mm or more, even if the wall thickness dimension of the white key 101D (the upper plate 131, the side plate 132 and the front plate 133) is set to the minimum value of 1 mm, the width dimension (distance between the opposed pair of the side plates 132, dimension in the direction of the arrow L-R) of the cavity can be made 12.5 mm (=22.5 mm−(4 mm+1 mm)×2). As a result, the cavity of the white key 101D can be made sufficiently smaller than the cavity in the white key made of a resin material only.

As long as the thickness dimension of the wood member 140S on one side is 10.5 mm or less, even if the wall thickness dimension of the white key 101D (the upper plate 131, the side plate 132 and the front plate 133) is set to 2 mm, by setting the thickness dimension of the wood member 140S on the other side to the minimum value of 4 mm, the width dimension (distance between the opposed pair of the side plates 132, dimension in the direction of the arrow L-R) of the cavity can be made 4 mm (=22.5 mm−(4 mm+10.5 mm)−(2 mm)×2). Therefore, the rigidity of both the base member 130D and the guide post 160 can be ensured.

In the present embodiment, as shown in FIG. 6B, to make the outside surface of the wood member 140S flush with the left and right end surfaces of the upper plate 131 in the base member 130D, a protrusion dimension of the upper plate 131 from the sticking surface 132*a* in the left-right direction (direction of the arrow L-R) and the thickness dimension of the wood member 140S are set.

Moreover, the outside surface of the wood member 140S may be disposed flush with the left and right end surfaces of the upper plate 131 in the base member 130D as in the present embodiment, or may be disposed more inward (toward the side of the sticking surface 132*a* of the side plate 132) and backward than the left and right end surfaces of the upper plate 131 in the base member 130D. A gap between the outside surface of the wood member 140S and the left and right end surfaces of the upper plate 131 in the base member 130D is preferably set within a range of 0 mm or more and 0.2 mm or less.

In this way, by making the outside surface of the wood member 140S flush with or more inward and backward than the left and right end surfaces of the upper plate 131, in a top view of the white key 101D, the wood member 140S can be prevented from being visually recognized by protruding from left and right sides of the upper plate 131 (touching surface). In addition, by setting an inward dimension to 0.2 mm or less so as to reduce the gap to the minimum, even in a side view of the white key 101D, a sense of unity is achieved between the base member 130D (the upper plate 131) and the wood member 140S so that the white key 101D can be improved in appearance. In addition, a finger can be prevented from being caught by the gap when pressing or releasing the white keys 101 adjacent to the white key 101D.

In this case, compared to the base member 130D formed by a mold, the wood member 140S formed of a wood material has a greater dimensional tolerance, and there is unevenness in thickness dimension along the longitudinal direction of the wood member 140S. In addition, the base member 130D itself also has a dimensional tolerance. Hence, if the wood member 140S is merely adhesively fixed to the sticking surface 132*a* of the side plate 132 of the base member 130D, in some cases, the gap between the outside surface of the wood member 140S and the left and right end surfaces of the upper plate 131 is out of the above range throughout or partially throughout the longitudinal direction (direction of the arrow F-B). In addition, in some cases, the width dimension (dimension in the direction of the arrow L-R) of the white key 101D itself is out of the specified range. Hence, it would be necessary to adjust the above gap or width dimension by performing a cutting process by moving a cutting tool such as an end mill or milling cutter along the left and right side surfaces of the white key 101D.

With respect to this, in the present embodiment, as shown in FIG. 6B, the outer shell surface 132*b* of the side plate 132 in the base member 130D is disposed more inward (toward the side of the sticking surface 132*a* of the side plate 132) and backward than the outside surface of the wood member 140S. Thus, when the cutting process is performed on the left and right side surfaces of the white key 101D, a portion formed of a resin material to be subjected to the cutting process simultaneously with the wood member 140S is limited to the left and right end surfaces of the upper plate 131, and a region of the base member 130D to be subjected to the cutting process can be reduced as small as possible. Therefore, damage to the base member 130D can be reduced.

That is, conditions suitable for the cutting process are different between wood material and resin material. Hence, as in the present embodiment, on the left and right side surfaces of the white key 101D, the outer shell surface 132*b* of the side plate 132 in the base member 130D is recessed more inward and backward than the outside surface of the wood member 140S. Thus, the region to undergo the cutting process by a processing blade of the cutting tool can be limited to the left and right end surfaces of the upper plate 131 that is relatively thin, and the processing blade can avoid contacting a large area of the portion formed of a resin material. Therefore, damage such as cracking or chipping due to unnecessary involvement with the processing blade can be prevented from occurring to the base member 130D.

Figure 7A:
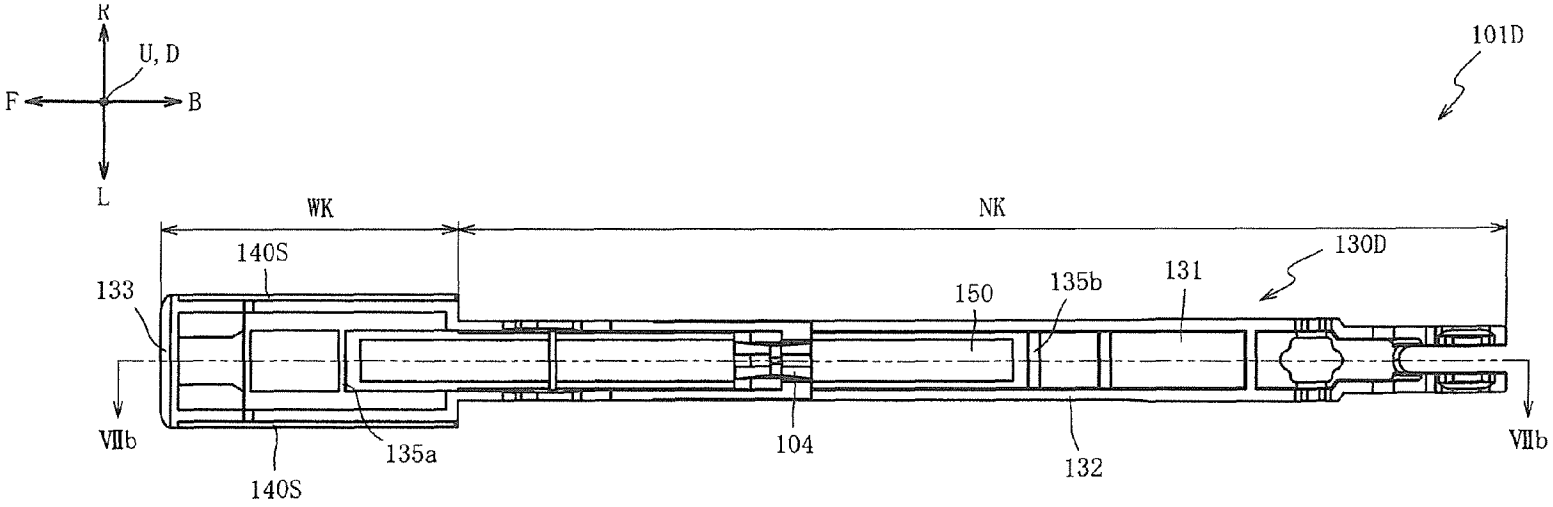
FIG. 7A is a bottom view of a white key.
Figure 7B:
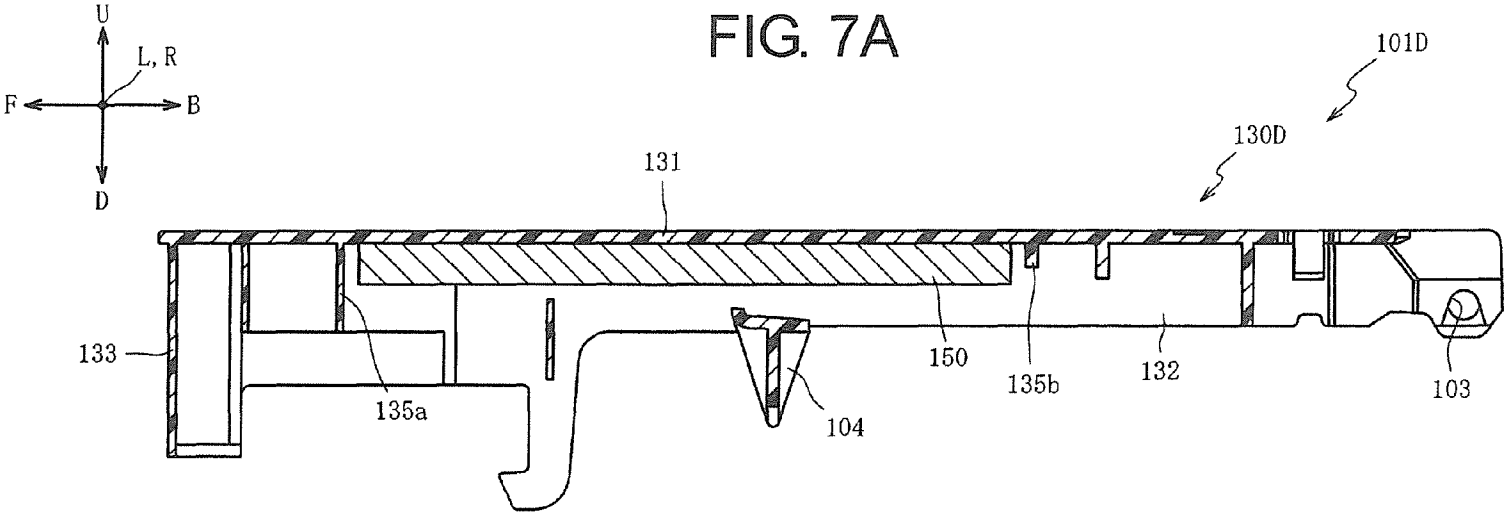
FIG. 7B is a cross-sectional view of the white key taken on line VIIb-VIIb in FIG. 7A.

FIG. 7A is a bottom view of the white key 101D. FIG. 7B is a cross-sectional view of the white key 101D taken on line VIIb-VIIb in FIG. 7A.

Here, in the first group (the white keys 101C, 101E, 101F, 101B and 101A'), the wood member 140L having a long longitudinal dimension is disposed across a total length (i.e., the wide-width portion WK and the narrow-width portion NK) of the base members 130C, etc. (see FIG. 4). Hence, the base members 130C, etc. are reinforced by such wood member 140L, so as to ensure rigidity of the white keys 101C, etc. as a whole. Meanwhile, in the second group (the white keys 101D, 101G and 101A), the wood member 140S having a short longitudinal dimension is disposed only on the wide-width portion WK of the base members 130D, etc. but not on the narrow-width portion NK thereof (see FIG. 4). Hence, rigidity of the narrow-width portion NK of the base members 130D, etc. is low, and there is a risk that rigidity of the white keys 101D, etc. as a whole cannot be sufficiently ensured.

In this case, as a method of reinforcing the base members 130D, etc., a method of integrally forming a reinforcing portion for the base members 130D, etc. (e.g., partially thickening the upper plate 131) can be considered. However, if such method is adopted, a sink mark easily occurs during molding due to unevenness in thickness dimension, so as to cause degradation in appearance or yield. Meanwhile, a thickening approach capable of preventing occurrence of a sink mark is not capable of sufficiently improving rigidity.

In addition, compared to the first group (the white keys 101C, 101E, 101F, 101B and 101A'), in the second group (the white keys 101D, 101G and 101A), because no wood member 140L having a long longitudinal dimension is disposed on the narrow-width portion NK of the base members 130D, etc., the width dimension (distance between the opposed pair of the side plates 132) of the cavity is increased accordingly (see FIG. 4). Hence, in the second group, the cavity becomes larger, and when the touching surface is touched by the player's fingernail, the cavity easily resonates to produce unpleasant noise.

Accordingly, in the present embodiment, a rigid member 150 made of a material (wood material) having higher rigidity than the base members 130D, etc. is disposed in the second group (the white keys 101D, 101G and 101A) along the longitudinal dimension of the base members 130D, etc. Thus, occurrence of a sink mark during molding is prevented and the rigidity of the white keys 101D, etc. as a whole is improved. In addition, by disposing the rigid member 150 inside the cavity of the base members 130D, etc., the cavity is made smaller accordingly, so that occurrence of unpleasant noise can be prevented when the touching surface is touched by a fingernail. A detailed configuration of the rigid member 150 is described hereinafter with reference to the white key 101D as the representative example of the second group.

As shown in FIGS. 7A and 7B, the rigid member 150 is a member formed of a wood material (medium density fiber board in the present embodiment) and having a long rod shape square in cross section. The rigid member 150 is disposed inside the cavity of the base member 130D and adhesively fixed to the lower surface (surface on the lower side in FIG. 7B) of the upper plate 131 by means of an adhesive. Accordingly, due to the volume of the rigid member 150, the cavity of the base member 130D is made smaller, so that resonance of the cavity can be prevented.

Further, since the upper plate 131 itself in the base member 130D can be improved in rigidity through the disposition (adhesive fixation) of the rigid member 150 thereon, vibration of the upper plate 131 at the time the touching surface is touched by the player's fingernail can be prevented. As a result, for example, compared to a case where the rigid member 150 is disposed on an inner wall surface of the side plate 132, vibration is hardly transmitted to the cavity, so that resonance of the cavity can be prevented. Thus, occurrence of unpleasant noise can be more effectively prevented.

Particularly, in the present embodiment, the rigid member 150 is formed of a wood material. Thus, not only suppression of deformation of or damage to the base member 130D and reduction in product weight are both achieved, but also occurrence of unpleasant noise can be more effectively prevented. That is, a wood material has higher rigidity than a resin material while having smaller specific gravity (i.e., larger volume per unit weight) than a metal material. Therefore, since the rigid member 150 is formed of a wood material, the rigidity of the base member 130D can be further improved compared to a case where the rigid member 150 is formed of a resin material of the same weight; meanwhile, the volume of the cavity can be further reduced compared to a case where the rigid member 150 is formed of a metal material of the same weight. As a result, weight reduction, rigidity improvement and cavity resonance prevention (prevention of occurrence of unpleasant noise) can be achieved at the same time.

Moreover, in the present embodiment, the rigid member 150 is formed square in cross section as cut by a plane orthogonal to the longitudinal direction thereof, and is also formed as a rod-like body having a constant cross-sectional area along the longitudinal direction. Thus, directionality of the rigid member 150 in the longitudinal direction and the circumferential direction can be eliminated. Therefore, when the rigid member 150 is disposed inside (inserted into) the cavity of the base member 130D, there is no need to take orientations of the longitudinal direction and the circumferential direction of the rigid member 150 into consideration, and thus workability of the disposition-inside (insertion-into) operation can be improved. In addition, since the rigid member 150 itself is simplified in shape, when such rigid member 150 is manufactured by cutting, the manufacturing costs can be reduced.

A pair of protruding portions 135*a* and 135*b* is projected on the lower surface (surface on the lower side in FIG. 7B) of the upper plate 131 of the base member 130D, wherein the pair of the protruding portions 135*a* and 135*b* is disposed opposed to each other with a predetermined spacing therebetween along the longitudinal direction (direction of the arrow F-B) of the base member 130D. The rigid member 150 is disposed between the opposed pair of the protruding portions 135*a* and 135*b*.

In this case, the spacing between the opposed pair of the protruding portions 135*a* and 135*b* is set to a dimension a little larger than (1.05 times in the present embodiment) a longitudinal dimension of the rigid member 150. The protruding portion 135*a* on one side is disposed on the lower surface of the upper plate 131 of the wide-width portion WK, and the protruding portion 135*b* on the other side is disposed on the lower surface of the upper plate 131 of the narrow-width portion NK.

Therefore, the rigid member 150 is disposed across a boundary between the wide-width portion WK and the narrow-width portion NK of the base member 130D in the longitudinal direction (direction of the arrow F-B). Accordingly, stress at the boundary between the wide-width portion WK and the narrow-width portion NK (i.e., portion where stress easily concentrates when an external force acts during the key-pressing operation) can be effectively dispersed throughout the base member 130D via the rigid member 150. As a result, deformation of or damage to the base member 130D when the white key 101D is strongly tapped can be suppressed.

In addition, one end (leading end, on the side of the direction of the arrow F) of the rigid member 150 is disposed at a position to overlap a portion of the wood member 140S disposed on the wide-width portion WK (the sticking surface 132*a* of the side plate 132) as viewed in a direction (direction of the arrow R-L) orthogonal to the longitudinal direction of the base member 130D. That is, the rigid member 150 and the wood member 140S have a predetermined amount of overlapping margin along the longitudinal direction (direction of the arrow F-B).

In this case, the wood member 140S and the rigid member 150 are formed of a wood material and have an increased thickness dimension compared to the base member 130D. Hence, the wood member 140S and the rigid member 150 have higher rigidity than the base member 130D. Due to the above, if a region with no overlap between the wood member 140S and the rigid member 150 in the longitudinal direction (direction of the arrow F-B) is present in the base member 130D, when the external force during the key-pressing operation acts on the base member 130D, stress concentrates at such region, and the base member 130D becomes prone to deformation or damage.

With respect to this, in the present embodiment, the wood member 140S and the rigid member 150 have an overlapping portion (overlapping margin) as viewed in the direction orthogonal to the longitudinal direction of the base member 130D, as described above. Thus, when the external force during the key-pressing operation acts on the base member 130D, the stress can be dispersed throughout the base member 130D via the wood member 140S and the rigid member 150. As a result, deformation of or damage to the base member 130D when the white key 101D is strongly tapped can be suppressed.

In addition, the other end (rear end, on the side of the direction of the arrow B) of the rigid member 150 is disposed at a position across the hammer engaging portion 104 disposed on the narrow-width portion NK (below the side plate 132) as viewed in the direction (direction of the arrow R-L or U-D) orthogonal to the longitudinal direction of the base member 130D. That is, the rigid member 150 is disposed at a position across the hammer engaging portion 104 along the longitudinal direction (direction of the arrow F-B) of the base member 130D.

Accordingly, when a reaction force generated by the pressing of the white key 101D acts from the hammer 120 (the receiving portion 124) to the hammer engaging portion 104, the reaction force acted on the hammer engaging portion 104 can be dispersed throughout the base member 130D via the rigid member 150. Thus, the stress can be prevented from concentrating in proximity to the hammer engaging portion 104 of the base member 130D. As a result, deformation of or damage to the base member 130D when the white key 101D is strongly tapped can be suppressed.

Here, as described above, the pair of the protruding portions 135*a* and 135*b* is disposed on the one end and the other end (end portion in the direction of the arrow F and end portion in the direction of the arrow B) of the rigid member 150. Hence, in the step of adhesively fixing the rigid member 150 to the lower surface (surface on the lower side in FIG. 7B) of the upper plate 131 in the base member 130D, displacement of such rigid member 150 in the longitudinal direction (direction of the arrow F-B) can be restricted by the protruding portions 135*a* and 135*b*. That is, positional deviation of the rigid member 150 in the longitudinal direction can be prevented. As a result, the rigid member 150 can be disposed (adhesively fixed) at a proper position with respect to the base member 130D, and an rigidity improvement effect of the rigid member 150 can be reliably and stably exhibited.

Moreover, as described above, the spacing between the opposed pair of the protruding portions 135*a* and 135*b* is larger than the longitudinal dimension of the rigid member 150, and predetermined clearances are formed between the protruding portions 135*a*, 135*b* and the one end and the other end of the rigid member 150. Therefore, when the rigid member 150 is inserted between the upper plate 131 and the hammer engaging portion 104 and disposed on the lower surface of the upper plate 131, due to the above clearances, the workability thereof can be ensured.

On the other hand, the above clearances cause the rigid member 150 to be disposed at indefinite positions in the longitudinal direction (direction of the arrow F-B). However, in the present embodiment, dimensions of the above clearances are set such that, even if the rigid member 150 deviates to a position where it touches the protruding portion 135*a* or the protruding portion 135*b*, the overlapping margin between the wood member 140S and the rigid member 150 in the longitudinal direction is ensured, and the rigid member 150 can be across the hammer engaging portion 104 in the longitudinal direction. Therefore, the rigidity improvement effect of the rigid member 150 can be reliably exhibited.

As shown in FIG. 7A, the pair of the protruding portions 135*a* and 135*b* is each connected to the lower surface of the upper plate 131 and the opposing surfaces (inner wall surfaces) of the pair of the side plates 132. That is, the pair of the protruding portions 135*a* and 135*b* is each connected to left and right inner wall surfaces that define the cavity of the base member 130D.

Therefore, when one side surface of the rigid member 150 is adhesively fixed to the lower surface of the upper plate 131 in the base member 130D by means of an adhesive, the pair of the protruding portions 135*a* and 135*b* can function as walls for damming up the adhesive flowing from between the lower surface of the upper plate 131 and the one side surface of the rigid member 150 (between two adhered surfaces).

Figure 8A:
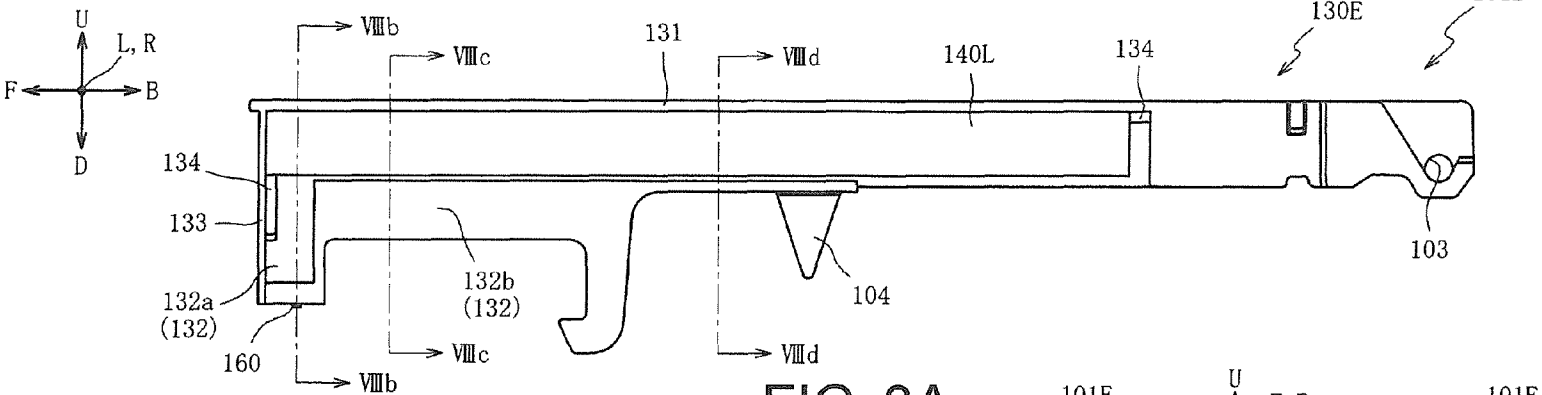
FIG. 8A is a side view of a white key.
Figure 8D:
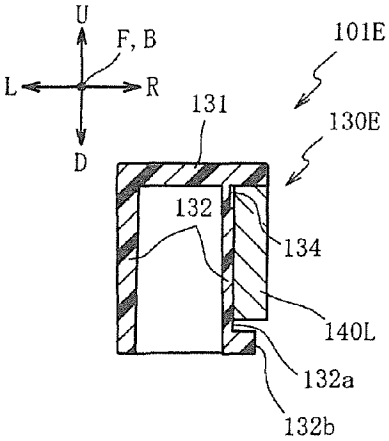
FIGS. 8B to 8D are respectively cross-sectional views of the white key taken on line VIIIb-VIIIb, line VIIIc-VIIIc and line VIIId-VIIId in FIG. 8A.
Figure 8C:
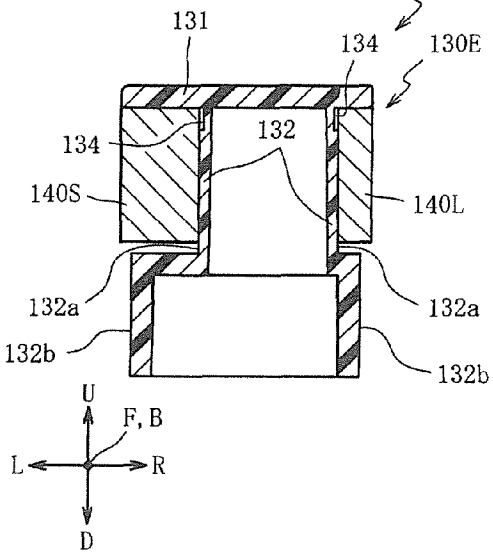
Figure 8B:
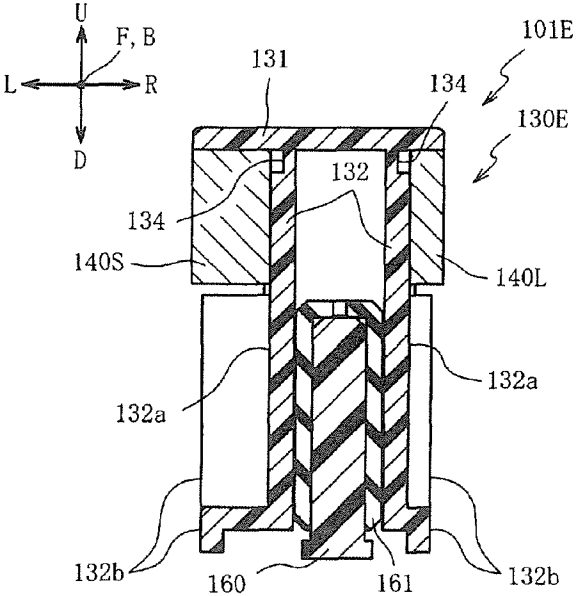

Next, the white key 101E as the representative example of the first group is described with reference to FIGS. 8A to 8D. FIG. 8A is a side view of the white key 101E. FIGS. 8B, 8C and 8D are respectively cross-sectional views of the white key 101E taken on line VIIIb-VIIIb, line VIIIc-VIIIc and line VIIId-VIIId in FIG. 8A.

Moreover, in FIGS. 8B to 8D, to facilitate understanding, a ratio of the thickness dimension of the wood member 140L to the thickness dimension of the wood member 140S is schematically illustrated in an enlarged manner compared to the actual ratio. In addition, in FIG. 8B, the guide post 160 disposed upright from the upper surface of the chassis 110 (see FIG. 2) is schematically illustrated.

As shown in FIGS. 8A to 8D, the wood member 140S having a short longitudinal dimension is disposed on one side surface (surface on the paper back side in FIG. 8A) of the left and right side surfaces of the base member 130E of the white key 101E, and the wood member 140L having a long longitudinal dimension is disposed on the other side surface (surface on the paper front side in FIG. 8A).

In this case, except that a formation range of the sticking surface 132*a* and the outer shell surface 132*b* on one side surface of the left and right side surfaces of the base member 130E is elongated in the longitudinal direction in contrast to the other side surface for allowing the wood member 140L having a long longitudinal dimension to be disposed on the base member 130E, the base member 130E is configured in substantially the same manner as the above base member 130D. Therefore, the same reference numerals denote the same portions as those of the base member 130D, and descriptions of the configurations, functions and effects of these portions are omitted.

Here, similarly to the white key 101E, if the wood members 140L and 140S having different longitudinal dimensions are disposed respectively on the left and right side surfaces of the base member 130E, there is a risk that leftward and rightward warpage (i.e., the white key 101E is curved such that a rear end side of the white key 101E is located in any of left and right directions (direction of the arrow L or the arrow R) when the white key 101E (the front plate 133) is viewed from the front (viewed in the direction of the arrow B)) may occur.

That is, in the case of the white key 101E, at the wide-width portion WK, since the wood members 140L and 140S are disposed respectively on the left and right sides of the base member 130E (see FIG. 4) and a relatively uniform balance is achieved between the left and right sides, the leftward and rightward warpage is relatively unlikely to occur. However, at the narrow-width portion NK, a region where the wood member 140L is disposed is formed on only either of the left and right sides of the base member 130E (see FIG. 4). In such region, when the temperature or humidity varies, the leftward and rightward warpage easily occurs as a result of difference in expansion rate between the resin material and the wood material.

When such leftward and rightward warpage occurs, the white keys 101 lined up in the left-right direction have non-uniform clearances therebetween (see FIG. 1A). Not only the appearance is spoiled, but also a performance may fail due to contact between the white keys 101. With respect to this, in the white key 101E, the wood member 140S having a short longitudinal dimension has a thickness dimension (dimension in the left-right direction, dimension in the direction of the arrow L-R) greater than the thickness dimension of the wood member 140L having a long longitudinal dimension, and the leftward and rightward warpage is thereby prevented.

That is, if the height dimensions (dimension in the direction of the arrow U-D) and thickness dimensions (dimension in the direction of the arrow L-R) are the same, the leftward and rightward warpage of the wood members 140L and 140S occurs in greater degree in the wood member 140L having a long longitudinal dimension than in the wood member 140S having a short longitudinal dimension. Hence, when the wood members 140L and 140S having different longitudinal dimensions are disposed respectively on the left and right sides of the base member 130E, under influence of the leftward and rightward warpage of the wood member 140L having a long longitudinal dimension, the white key 101E as a whole also warps in the same direction. In addition, if the height dimensions (dimension in the direction of the arrow U-D) and longitudinal dimensions (dimension in the direction of the arrow F-B) are the same, the wood member having a smaller (thinner) thickness dimension (dimension in the direction of the arrow L-R) has smaller degree of leftward and rightward warpage.

With respect to this, according to the white key 101E, the wood member 140S having a short longitudinal dimension has a thickness dimension greater than the thickness dimension of the wood member 140L having a long longitudinal dimension (i.e., the thickness dimension of the wood member 140L having a long longitudinal dimension is relatively reduced (thinned)). Accordingly, the influence of the leftward and rightward warpage of the wood member 140L having a long longitudinal dimension is reduced, and occurrence of leftward and rightward warpage of the white key 101E as a whole can be prevented. Moreover, if only either of the wood members 140L and 140S is to be changed in thickness dimension, it is preferred to reduce the thickness dimension of the wood member 140L. The reason is that, if the same amount of change in thickness dimension applies to both the wood members 140L and 140S, the degree of the leftward and rightward warpage of the wood member 140L can be reduced more than that of the wood member 140S, which accordingly contributes to prevention of the leftward and rightward warpage of the white key 101E.

In addition, according to the white key 101E, by increasing the thickness dimension of the wood member 140S having a short longitudinal dimension, the width dimension (spacing between the opposed pair of the side plates 132) of the cavity of the base member 130E can be reduced accordingly. As a result, the cavity can be prevented from resonating when the touching surface is touched by the player's fingernail, so that unpleasant noise is less likely to occur.

The wood members 140L and 140S of the white key 101E are disposed on the left and right side surfaces (the sticking surface 132*a*) of the base member 130E with their wood rear sides or wood surface sides facing each other. Therefore, directions of warpage of the wood members 140L and 140S are made opposite each other so that the warpage can be canceled out. Accordingly, the leftward and rightward warpage of the white key 101E as a whole can be prevented.

Moreover, the wood surface and the wood rear of the wood members 140L and 140S are defined as follows: when a log is sawed into lumber with cross grains, a surface closer to the bark of the log is the wood surface, and a surface closer to the heart of the log is the wood rear. In this case, the wood members 140L and 140S warp such that their wood rear sides protrude (their wood surface sides are depressed).

Please refer back to FIG. 4. As described above, in the present embodiment, among the first group (the white keys 101C, 101E, 101F, 101B and 101A') and the second group (the white keys 101D, 101G and 101A), the rigid member 150 is disposed only in the second group. Thus, a difference in weight between the first and second groups of the white keys 101 can be reduced. Accordingly, when the player operates (presses or releases) the white keys 101, a uniform operation feeling can be obtained by the player from each key in the first and second groups.

Moreover, the wood members 140L and 140S and the rigid member 150 are preferably formed such that a total weight of one wood member 140S and one wood member 140L is equal to a total weight of two wood members 140S and one rigid member 150. The reason is that, by doing so, the difference in weight between the first and second groups of the white keys 101 can be reduced.

In addition, in this case, it is further preferred to set the weights of each of the base members 130C, 130E, 130F, 130B and 130A' in the first group and the base members 130D, 130G and 130A in the second group the same. The reason is that, by doing so, the first group of the white keys 101 have the same weight as the second group of the white keys 101, and an improved uniform operation feeling can be obtained by the player from each key in the first and second groups when the player operates (presses or releases) the white keys 101.

Next, a keyboard device according to the second embodiment is described with reference to FIGS. 9A and 9B. The same reference numerals denote the same portions as those in the above first embodiment, and descriptions thereof are omitted.

Figure 9B:
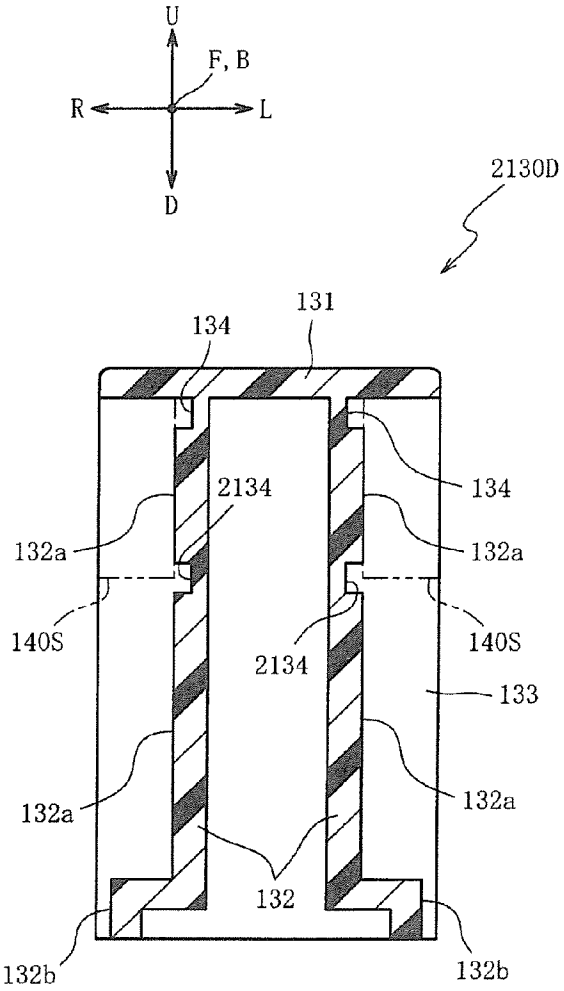
FIG. 9B is a cross-sectional view of the base member taken on line IXb-IXb in FIG. 9A.
Figure 9A:
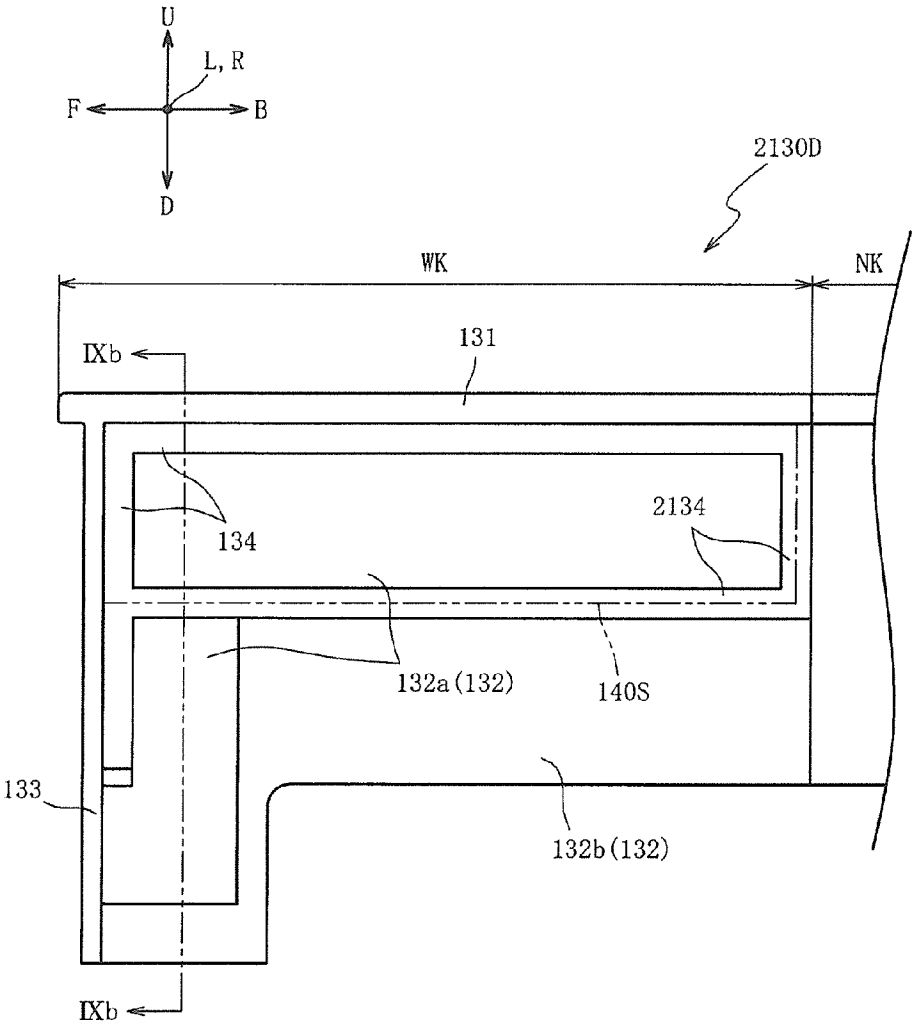
FIG. 9A is a partially enlarged side view of a base member according to the second embodiment.

FIG. 9A is a partially enlarged side view of a base member 2130D according to the second embodiment. FIG. 9B is a cross-sectional view of the base member 2130D taken on line IXb-IXb in FIG. 9A. Moreover, in FIGS. 9A and 9B, the appearance of the wood member 140S is schematically illustrated in chain double-dashed lines.

As shown in FIGS. 9A and 9B, in the same manner as in the first embodiment, the two concave grooves 134 are depressed along the two sides of the outer edge of the sticking surface 132*a* of the base member 2130D that are connected respectively to the lower surface (surface on the lower side in FIG. 9A) of the upper plate 131 and the back surface (surface on the right side in FIG. 9A) of the front plate 133. In addition, in the second embodiment, two concave grooves 2134 are further depressed at positions opposed to the two concave grooves 134 with a predetermined spacing between themselves and the two concave grooves 134. That is, the concave grooves 134 and 2134 are depressed in the sticking surface 132*a* in a region that includes the four sides corresponding to the outer edge of the inside surface (surface adhesively fixed to the sticking surface 132*a*) of the wood member 140S disposed on the sticking surface 132*a*.

Accordingly, even if a burr protrudes from any of the four sides corresponding to the outer edge of the inside surface of the wood member 140S, the burr can be reliably received (relieved) by any of the four concave grooves 134 and 2134. As a result, the inside surface of the wood member 140S can be tightly stuck to the sticking surface 132*a* of the base member 2130D, so that lifting of the wood member 140S or formation of a clearance can be reliably prevented.

In addition, as in this case, the four concave grooves 134 and 2134 are depressed corresponding to the four sides of the outer edge of the inside surface of the wood member 140S. Thus, even if an adhesive flows in any direction from between the sticking surface 132*a* of the base member 2130D and the inside surface of the wood member 140S (between two adhered surfaces), such adhesive can be reliably accommodated in any of the four concave grooves 134 and 2134.

Next, keyboard devices according to the third to the fifth embodiments are described with reference to FIGS. 10A to 10C. The same reference numerals denote the same portions as those in the above embodiments, and descriptions thereof are omitted.

Figures 10A, 10B, 10C:
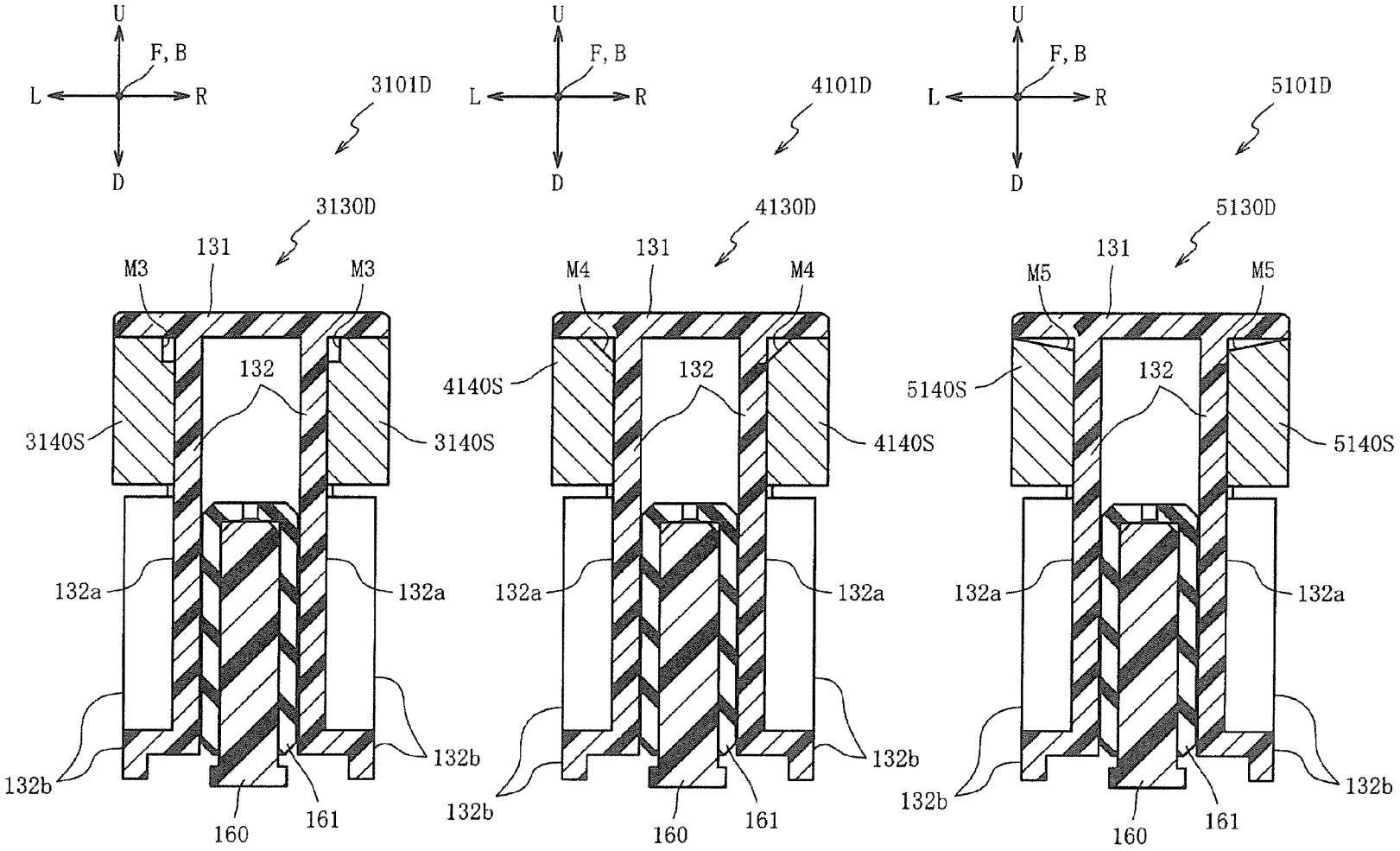
FIG. 10A is a cross-sectional view of a white key according to the third embodiment.
FIG. 10B is a cross-sectional view of a white key according to the fourth embodiment.
FIG. 10C is a cross-sectional view of a white key according to the fifth embodiment.

FIG. 10A is a cross-sectional view of a white key 3101D according to the third embodiment. FIG. 10B is a cross-sectional view of a white key 4101D according to the fourth embodiment. FIG. 10C is a cross-sectional view of a white key 5101D according to the fifth embodiment. Moreover, the cross sections shown in FIGS. 10A to 10C correspond to that shown in FIG. 6B.

As shown in FIGS. 10A to 10C, in the third to the fifth embodiments, while depression of the concave groove 134 (see FIGS. 6A and 6B) in the sticking surface 132*a* of base members 3130D to 5130D is omitted, chamfered portions M3 to M5 are formed on the outer edge of the inside surface (surface adhesively fixed to the sticking surface 132*a*) of wood members 3140S to 5140S by a chamfering process.

The chamfered portion M3 is formed by removing the outer edge (ridge portion) of the inside surface of the wood member 3140S in a shape rectangular in cross section. The chamfered portions M4 and M5 are formed by obliquely removing the outer edge (ridge portion) of the inside surface of the wood members 4140S and 5140S. Moreover, the chamfered portion M4 is formed by 45° C.-chamfering in which an isosceles triangle is removed from a corner. The chamfered portion M5 is formed by C-chamfering in which a scalene triangle is removed from a corner, one of three sides of the scalene triangle being as long as the thickness dimension (dimension in the direction of the arrow L-R) of the wood member 5140S.

According to the third to the fifth embodiments, due to formation of the chamfered portions M3 to M5, a burr can be removed in advance from the outer edge of the inside surface (surface adhesively fixed to the sticking surface 132*a*) of the wood members 3140S to 5140S. Thus, the inside surface of the wood members 3140S to 5140S can be easily tightly stuck to the sticking surface 132*a* of the base members 3130D to 5130D. Therefore, lifting of the wood members 3140S to 5140S is prevented, so that formation of a gap between the wood members 3140S to 5140S and the left and right end surfaces of the upper plate 131 and the front plate 133 can be prevented. As a result, not only the appearance of the white keys 3101D to 5101D can be prevented from being spoiled, but also the player's finger can be prevented from being caught by the gap when pressing the white keys 101 adjacent to the white keys 3101D to 5101D.

In addition, in this manner, since the chamfered portions M3 to M5 are formed on the outer edge of the inside surface (surface adhesively fixed to the sticking surface 132*a*) of the wood members 3140S to 5140S, an adhesive flowing from between the sticking surface 132*a* of the base members 3130D to 5130D and the inside surface of the wood members 3140S to 5140S (between two adhered surfaces) can be accommodated in a space formed by the chamfered portions M3 to M5. Thus, a step of wiping to remove the adhesive that extends from boundary portions between the upper plate 131, the front plate 133 and the wood members 3140S to 5140S in the base members 3130D to 5130D to the outside can be omitted.

Moreover, in the present embodiment, the chamfered portions M3 to M5 are formed on only two of the four sides of the outer edge of the inside surface of the wood members 3140S to 5140S, the two sides being connected respectively to the lower surface of the upper plate 131 and the back surface of the front plate 133 in the base members 3130D to 5130D. Accordingly, formation of a clearance between the side surfaces of the wood members 3140S to 5140S and the lower surface of the upper plate 131 and the back surface of the front plate 133 in the base members 3130D to 5130D is prevented so that the appearance can be prevented from being spoiled. Meanwhile, a workload required for the chamfering process is reduced, and the manufacturing costs can be reduced.

Figure 11:
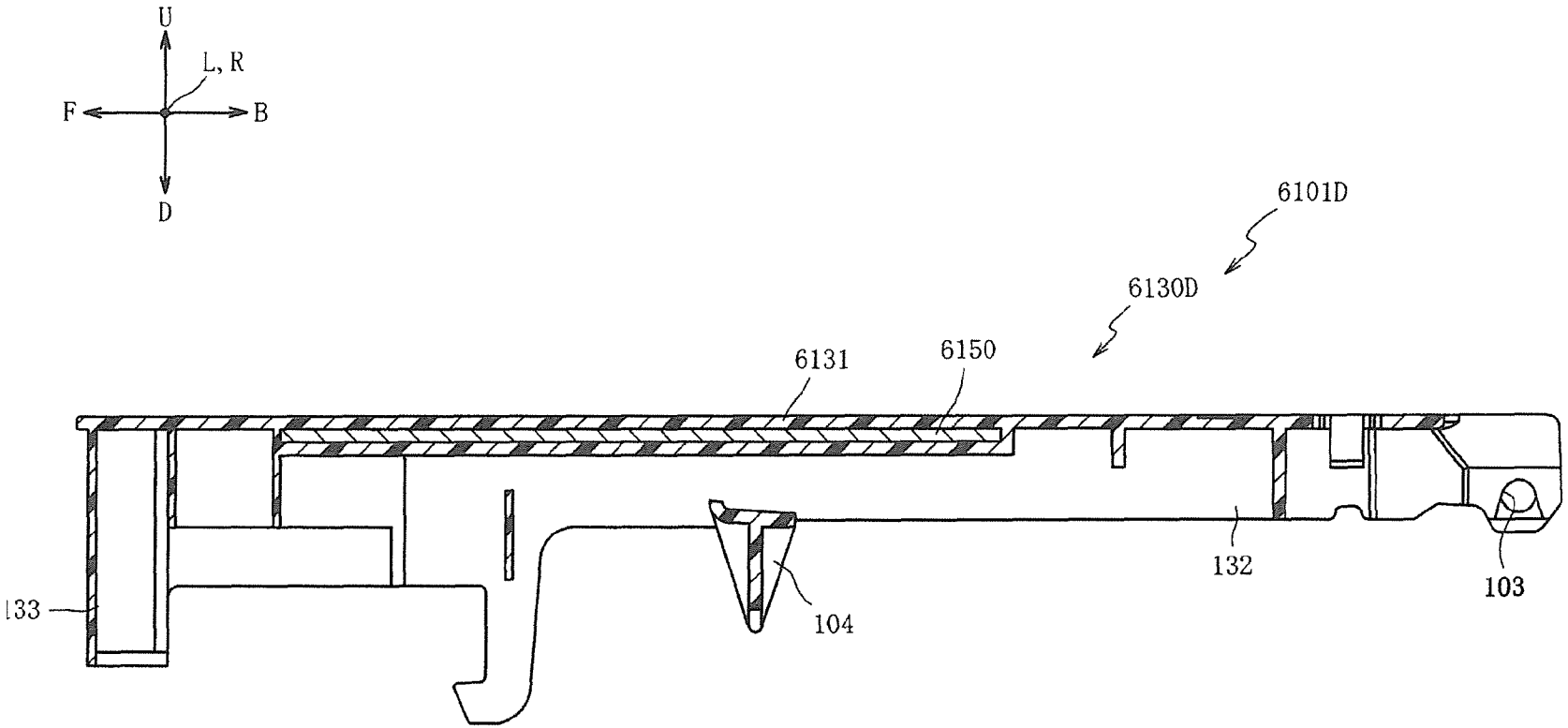
FIG. 11 is a cross-sectional view of a white key according to the sixth embodiment.

Next, a keyboard device according to the sixth embodiment is described with reference to FIG. 11. FIG. 11 is a cross-sectional view of a white key 6101D according to the sixth embodiment. Moreover, the cross section shown in FIG. 11 corresponds to that shown in FIG. 7B. In addition, the same reference numerals denote the same portions as those in the above embodiments, and descriptions thereof are omitted.

As shown in FIG. 11, a base member 6130D according to the sixth embodiment is integrally formed of a resin material by injection molding (insert molding) and includes an upper plate 6131, a pair of the side plates 132 and the front plate 133, wherein the upper plate 6131 forms the touching surface on its upper surface (surface on the upper side in FIG. 11) and has a rigid member 6150 buried therein.

The rigid member 6150 is a member formed of a metal material and having a long flat plate shape. The upper plate 6131 is buried in a manner that the longitudinal direction of the rigid member 6150 is along the longitudinal direction (direction of the arrow F-B) of the base member 6130D and parallel to the touching surface. Accordingly, since the upper plate 6131 itself of the base member 6130D can be improved in rigidity, vibration of the upper plate 6131 at the time the touching surface is touched by the player's fingernail can be prevented. As a result, for example, compared to a case where the rigid member 6150 is buried in the side plate 132, vibration is hardly transmitted to the cavity, so that resonance of the cavity can be prevented. Thus, occurrence of unpleasant noise can be effectively prevented.

In addition, according to the sixth embodiment, the rigid member 6150 can be buried in the upper plate 6131 concurrently with the step of injection molding the base member 6130D. Thus, operations such as applying the adhesive (or attaching the double-sided tape) for fixing the rigid member 150 to the base member 130D or disposing the rigid member 150 inside the cavity of the base member 130D as in the first embodiment (see FIGS. 7A and 7B) are unnecessary. Accordingly, the manufacturing costs can be reduced.

Moreover, in the same manner as in the first embodiment, the rigid member 6150 has one end (leading end, on the side of the direction of the arrow F) disposed at a position overlapping a portion of the wood member 140S (see FIG. 7A) and the other end (rear end, on the side of the direction of the arrow B) disposed at a position across the hammer engaging portion 104. Accordingly, as described above, by use of rigidity of the rigid member 6150, deformation of or damage to the base member 6130D when the white key 6101D is strongly tapped can be suppressed.

Next, keyboard devices according to the seventh and eighth embodiments are described with reference to FIGS. 12A to 12C.

Figure 12A:
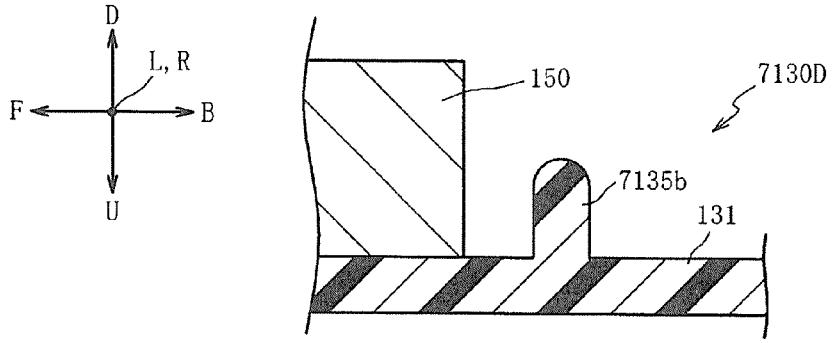
FIG. 12A is a partially enlarged cross-sectional view of a white key according to the seventh embodiment.

FIG. 12A is a partially enlarged cross-sectional view of a white key 7101D according to the seventh embodiment. FIG. 12B is a partially enlarged cross-sectional view of the white key 7101D during a step in which the rigid member 150 is disposed on a base member 7130D. Moreover, the cross sections shown in FIGS. 12A and 12B correspond to that shown in FIG. 7B (however, the up-down direction in FIGS. 12A and 12B is shown reversed from that in FIG. 7B). In addition, the same reference numerals denote the same portions as those in the above embodiments, and descriptions thereof are omitted.

Figure 12B:
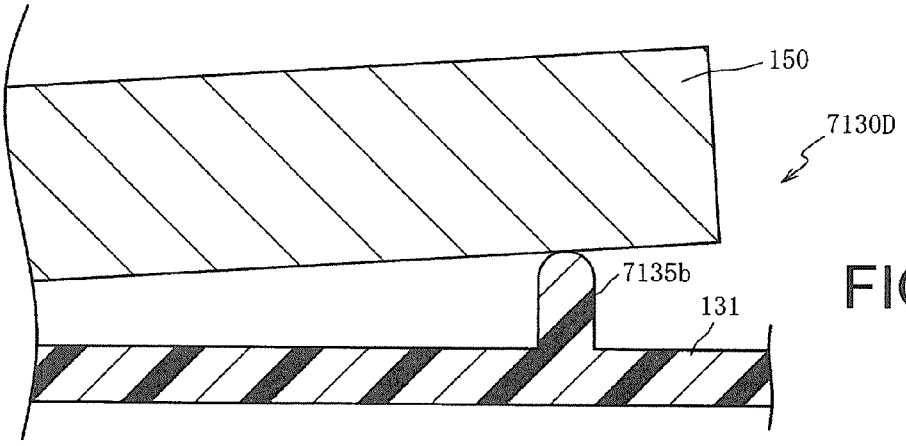
FIG. 12B is a partially enlarged cross-sectional view of the white key during a step in which a rigid member is disposed on a base member.

As shown in FIGS. 12A and 12B, in the seventh embodiment, a pair of protruding portions 135*a* and 7135*b* (please refer to FIGS. 7A and 7B for details of the protruding portion 135*a*) is projected from the lower surface (surface on the upper side in FIG. 12A) of the upper plate 131 in the base member 7130D, wherein the protruding portion 7135*b* located on the rear end (on the side of the direction of the arrow B) is formed having a projected leading end curved in an arc shape. That is, the protruding portion 7135*b* has a reduced cross-sectional area on the projected leading end side in a cross section as cut by a plane orthogonal to the left-right direction of the base member 7130D. Accordingly, when the rigid member 150 is slid on the projected leading end of the protruding portion 7135*b* and disposed on the lower surface of the upper plate 131, frictional resistance between the rigid member 150 and the protruding portion 7135*b* can be reduced to enable smooth disposition of the rigid member 150.

Particularly, in the present embodiment, the operation of disposing the rigid member 150 on the lower surface of the upper plate 131 is performed while inserting one end (on the side of the direction of the arrow F) of the rigid member 150 between the upper plate 131 and the hammer engaging portion 104 from more toward the rear end side (side of the direction of the arrow B) than the hammer engaging portion 104 (see FIG. 7B). For that reason, in a latter stage of the disposition operation, it is necessary to lay down the rigid member 150 toward the side of the upper plate 131. In addition, due to narrow spacing between the opposed pair of the side plates 132, the other end side (side of the direction of the arrow B) of the rigid member 150 is to be placed on the projected leading end of the protruding portion 7135*b* (see FIG. 12B) and such rigid member 150 is to be pushed forward (in the direction of the arrow F). Therefore, it becomes particularly effective to curve the projected leading end of the protruding portion 7135*b* into an arc shape so as to reduce the frictional resistance when the rigid member 150 is slid.

Figure 12C:
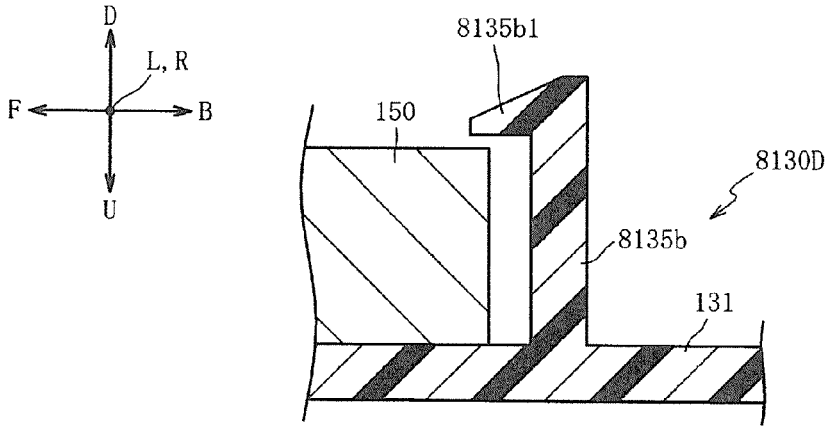
FIG. 12C is a partially enlarged cross-sectional view of a white key according to the eighth embodiment.

FIG. 12C is a partially enlarged cross-sectional view of a white key 8101D according to the eighth embodiment. Moreover, the cross section shown in FIG. 12C corresponds to that shown in FIG. 7B (however, the up-down direction in FIG. 12C is shown reversed from that in FIG. 7B). In addition, the same reference numerals denote the same portions as those in the above embodiments, and descriptions thereof are omitted.

As shown in FIG. 12C, in the eighth embodiment, a pair of protruding portions 135*a* and 8135*b* (please refer to FIGS. 7A and 7B for details of the protruding portion 135*a*) is projected from the lower surface (surface on the upper side in FIG. 12C) of the upper plate 131 in a base member 8130D, wherein the protruding portion 8135*b* located on the rear end (on the side of the direction of the arrow B) includes an extension portion 8135*b*1. The extension portion 8135*b*1 is a portion extending from a projected leading end portion of the protruding portion 8135*b* toward the protruding portion 135*a* on the other side, and is formed spaced from the lower surface of the upper plate 131 to allow the rigid member 150 to be interposed therebetween.

Accordingly, while the rigid member 150 is disposed on the lower surface of the upper plate 131 in the base member 8130D, since the rigid member 150 can be interposed between the lower surface of the upper plate 131 and the extension portion 8135*b*1 of the protruding portion 8135*b*, such rigid member 150 can be kept on the lower surface of the upper plate 131 in the base member 8130D. Therefore, for example, if the key is strongly tapped during a step of curing the adhesive for adhesively fixing the rigid member 150 to the lower surface of the upper plate 131 or in a product state, etc., the rigid member 150 can be prevented from falling off from the base member 8130D.

Moreover, an inclined plane is formed on an upper surface of the extension portion 8135*b*1 of the protruding portion 8135*b* and inclined in a manner that the inclined plane is closer to the lower surface of the upper plate 131 toward an extended leading end side (side of the direction of the arrow F) of the extension portion 8135*b*1. Therefore, the rear end of the rigid member 150 can be guided by the upper surface (inclined plane) of the extension portion 8135*b*1, so as to enable smooth disposition of the rigid member 150 on the lower surface of the upper plate 131.

In addition, due to formation of the inclined plane, the protruding portion 8135*b* is formed into a trapezoidal shape in cross section with the projected leading end side being tapered. That is, the protruding portion 8135*b* has a reduced cross-sectional area on the projected leading end side in the cross section shown in FIG. 12C that is cut by a plane orthogonal to the left-right direction of the base member 8130D. Accordingly, when the rigid member 150 is slid on the projected leading end of the protruding portion 8135*b* and disposed on the lower surface of the upper plate 131, frictional resistance between the rigid member 150 and the protruding portion 8135*b* can be reduced to enable smooth disposition of the rigid member 150.

In this case, the protruding portion 8135*b* is preferably separated from (instead of being connected to) the left and right side plates 132 (see FIGS. 7A and 7B). The reason is that, by doing so, when the rigid member 150 is disposed on the lower surface of the upper plate 131, a corner on the rear end side (side of the direction of the arrow B) of the rigid member 150 touches the inclined plane of the extension portion 8135*b*1 to elastically deform the protruding portion 8135*b* in a manner that the protruding portion 8135*b* warps backward (in the direction of the arrow B), so that the rigid member 150 can be easily disposed. Another reason is that, by making the protruding portion 8135*b* elastically deformable, spacing between the opposed pair of the protruding portions 135*a* and 8135*b* is close to a total length of the rigid member 150, and thus making it easy for the extension portion 8135*b*1 to engage with the rigid member 150.

In addition, if the protruding portion 8135*b* is separated from (instead of being connected to) the left and right side plates 132 (see FIGS. 7A and 7B), the protruding portion 8135*b* may also be partially connected to the left and right side plates 132 only by its base end side (side connected to the lower surface of the upper plate 131). The reason is that, by doing so, elastic deformation properties of the protruding portion 8135*b* can be ensured, and the function of the protruding portion 8135*b* as a wall for damming up the adhesive can also be ensured.

Figure 13A:
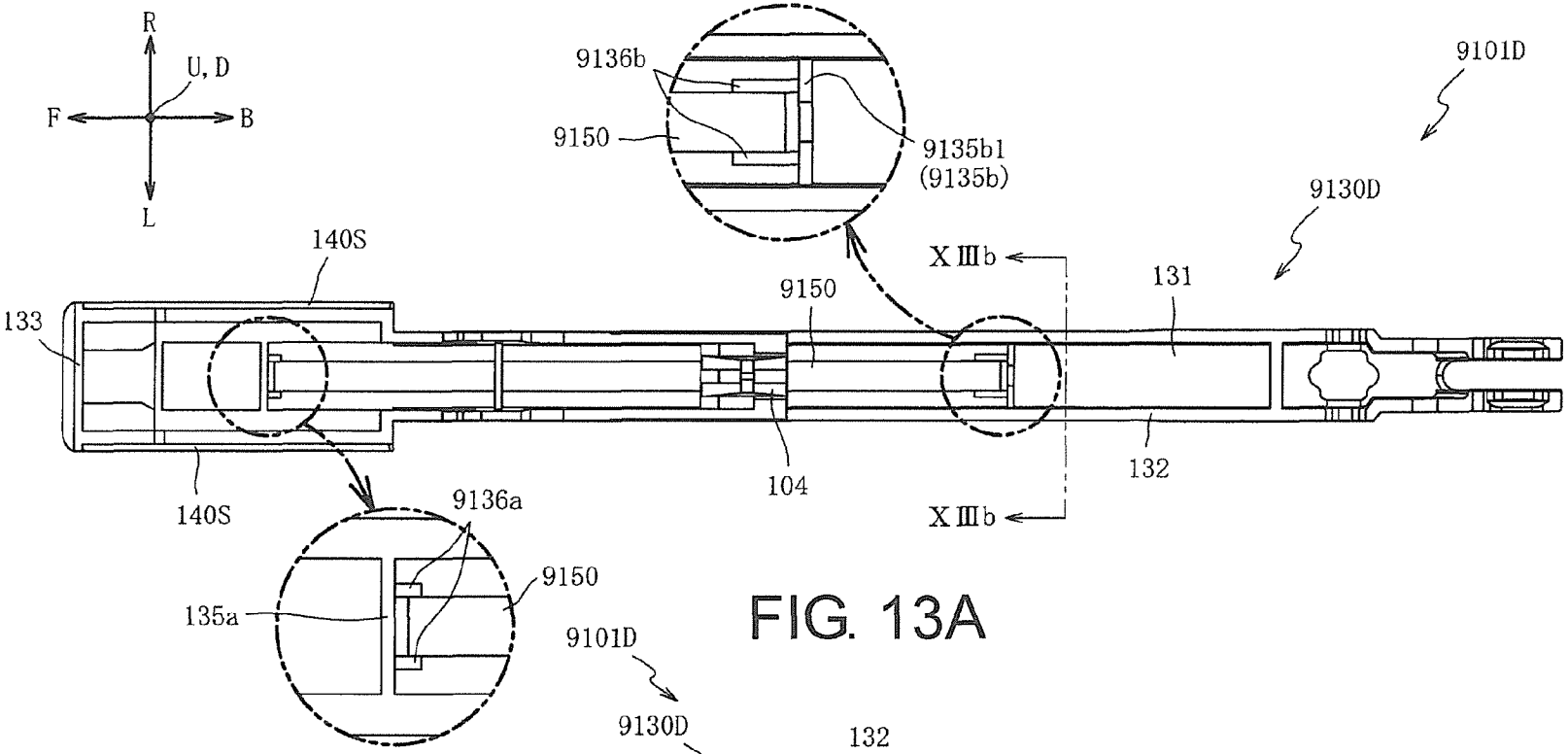
FIG. 13A is a bottom view of a white key according to the ninth embodiment.
Figure 13B:
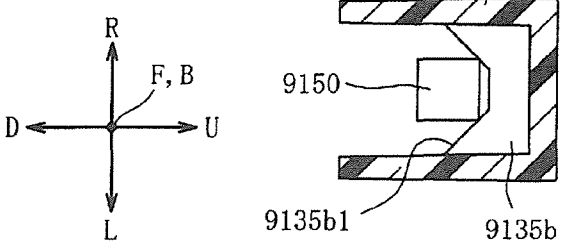
FIG. 13B is a cross-sectional view of the white key taken on line XIIIb-XIIIb in FIG. 13A.

Next, a keyboard device according to the ninth embodiment is described with reference to FIGS. 13A and 13B. FIG. 13A is a bottom view of a white key 9101D according to the ninth embodiment. FIG. 13B is a cross-sectional view of the white key 9101D taken on line XIIIb-XIIIb in FIG. 13A. Moreover, FIG. 13B illustrates a state that a rigid member 9150 is placed in a recess portion 9135*b*1 of a protruding portion 9135*b*. In addition, the same reference numerals denote the same portions as those in the above embodiments, and descriptions thereof are omitted.

As shown in FIGS. 13A and 13B, in the ninth embodiment, a pair of the protruding portions 135*a* and 9135*b* is projected from the lower surface (surface on the paper front side in FIG. 13A) of the upper plate 131 in a base member 9130D, wherein the protruding portion 9135*b* located on the rear end (on the side of the direction of the arrow B) includes the recess portion 9135*b*1.

The recess portion 9135*b*1 is formed on a projected leading end of the protruding portion 9135*b* and has a V shape as viewed in a longitudinal direction (viewed in the direction of the arrow F-B) of the base member 9130D (see FIG. 13B). The recess portion 9135*b*1 includes a pair of inclined planes having a spacing (dimension in the direction of the arrow L-R) therebetween becoming narrower as approaching the upper plate 131. The minimum spacing between the pair of inclined planes is smaller than a width dimension (dimension in the direction of the arrow L-R) of the rigid member 9150, and the maximum spacing therebetween is larger than the width dimension of the rigid member 9150.

Accordingly, when the rigid member 9150 is slid on the projected leading end of the protruding portion 9135*b* and disposed on the lower surface of the upper plate 131 in the base member 9130D (pushed in the direction of the arrow F), as shown in FIG. 13B, only left and right corners of the rigid member 9150 can touch the pair of inclined planes of the recess portion 9135*b*1, and frictional resistance between the rigid member 9150 and the protruding portion 9135*b* can be reduced. Accordingly, the rigid member 9150 can be smoothly disposed (pushed in the direction of the arrow F).

Further, during the disposition (pushing in the direction of the arrow F) of the rigid member 9150, since only the left and right corners of the rigid member 9150 contact the projected leading end (the inclined planes of the recess portion 9135*b*1) of the protruding portion 9135*b*, a clearance can be formed between an upper surface (surface on the right side in FIG. 13B) of the rigid member 9150 and the projected leading end of the protruding portion 9135*b*. Thus, an adhesive applied on the upper surface of the rigid member 9150 can be prevented from being scraped off by the projected leading end of the protruding portion 9135*b*.

In addition, in the ninth embodiment, opposed walls 9136*a* and 9136*b* are disposed in the base member 9130D. The opposed walls 9136*a* and 9136*b* are portions for determining a position of the rigid member 9150 with respect to the base member 9130D in the left-right direction (direction of the arrow L-R). The opposed walls 9136*a* and 9136*b* are projected from the lower surface (surface on the paper front side in FIG. 13A) of the upper plate 131 in the base member 9130D and are each formed as a pair of plate-like bodies disposed opposed to each other with a predetermined spacing therebetween along the left-right direction. Each pair of the plate-like bodies of the opposed walls 9136*a* and 9136*b* has a spacing a little larger than the width dimension of the rigid member 9150, so as to allow the rigid member 9150 to be disposed therein.

Accordingly, while the rigid member 9150 is disposed on the lower surface of the upper plate 131 in the base member 9130D, since displacement (positional deviation) of the rigid member 9150 with respect to the base member 9130D in the left-right direction can be restricted by the opposed walls 9136*a* and 9136*b*, the rigid member 9150 can be disposed at a proper position with respect to the base member 9130D. As a result, an effect caused by the disposition of the rigid member 9150 can be reliably exhibited. In addition, in the step of disposing the rigid member 9150 on the lower surface of the upper plate 131 in the base member 9130D, the disposition operation can be performed by taking the opposed walls 9136*a* and 9136*b* respectively as landmarks. Thus, positioning in the left-right direction can be made easy and workability thereof can be improved.

Figure 14:
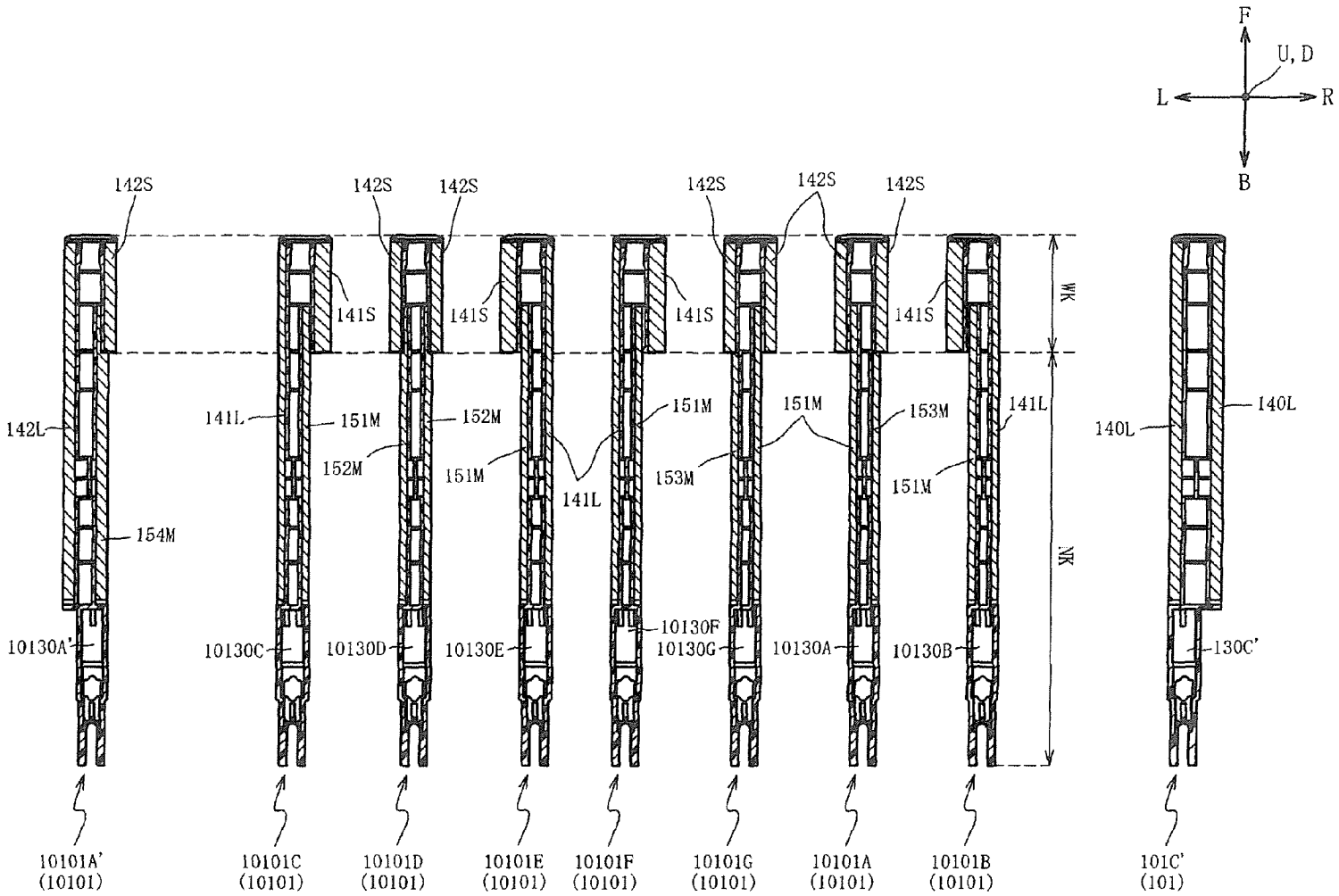
FIG. 14 is a cross-sectional view of a white key according to the tenth embodiment.

Next, a keyboard device according to the tenth embodiment is described with reference to FIG. 14. FIG. 14 is a cross-sectional view of white keys 10101 according to the tenth embodiment and corresponds to FIG. 4.

The first embodiment has described a case where the base members 130C to 130B and 130A' either have no wood member 140L disposed on the narrow-width portion NK or have the wood member 140L disposed on the narrow-width portion NK on only one side surface (i.e., there is up to one wood member 140L disposed on the narrow-width portion NK). In the tenth embodiment, the wood members 141L, etc. are respectively disposed on left and right side surfaces of the narrow-width portion NK of base members 10130C to 10130B and 10130A'. The same reference numerals denote the same portions as those in the above embodiments, and descriptions thereof are omitted.

Here, the base members 10130C to 10130B and 10130A' according to the tenth embodiment have substantially the same configuration as the base members 130C to 130B and 130A' according to the first embodiment, except that, compared to the base members 130C to 130B and 130A', the base members 10130C to 10130B and 10130A' have a smaller (narrower) width dimension (dimension in the direction of the arrow L-R) of the narrow-width portion NK, and have the sticking surface 132*a* on at least one of the left and right side surfaces of the narrow-width portion NK extending across the boundary between the narrow-width portion NK and the wide-width portion WK to the front side (side of the direction of the arrow F). In addition, while the wood members 141S, 142S, 141L, 142L and 151M to 154M according to the tenth embodiment have different thickness dimensions and longitudinal dimensions from those of the wood members 140S and 140L according to the first embodiment, their width dimensions (in the direction of the arrow U-D) are set the same. Only the different portions are described hereinafter, and descriptions of the same portions are omitted.

As shown in FIG. 14, a total of three wood members 141S, 141L and 151M are stuck to the left and right side surfaces (the sticking surface 132*a*) of the base members 10130C, 10130E, 10130F and 10130B of white keys 10101C, 10101E, 10101F and 10101B. Moreover, the white keys 10101C, 10101F are line-symmetrical with respect to the white keys 10101E, 10101B, respectively, with virtual lines along the direction of the arrow F-B as axes of symmetry.

Specifically, one of the left and right side surfaces of the base members 10130C, 10130E, 10130F and 10130B has the side surface of the wide-width portion WK disposed flush with the side surface of the narrow-width portion NK, and the wood member 140L is stuck to such one side surface. The other of the above left and right side surfaces has the side surface of the narrow-width portion NK disposed more inward and backward than the side surface of the wide-width portion WK and extending across the boundary between the narrow-width portion NK and the wide-width portion WK to the front side (side of the direction of the arrow F). On such other side surface, the wood member 141S is stuck to the side surface of the wide-width portion WK, and the wood member 151M is stuck to the side surface of the narrow-width portion NK including the extending portion.

In this case, the thickness dimensions of the wood members 141L and 151M are set substantially the same. Therefore, the wood members 141L and 151M having substantially the same thickness dimension are stuck respectively to the left and right side surfaces of the narrow-width portion NK. In addition, the wood member 151M is disposed across the boundary between the narrow-width portion NK and the wide-width portion WK on the other side surface of the narrow-width portion NK. Moreover, in the present embodiment, the thickness dimensions of the wood members 141L and 151M are set substantially half the thickness dimension of the wood member 141S. In addition, the wood members 141L and 151M are disposed on the left and right side surfaces (the sticking surface 132*a*) of the base members 10130C, etc. with their wood rear sides or wood surface sides facing each other.

A total of four wood members 142S and 152M are stuck to the left and right side surfaces (the sticking surface 132*a*) of the base member 10130D of a white key 10101D. Moreover, the white key 10101D is line-symmetrical as viewed from above with its center line as an axis of symmetry.

Specifically, the left and right side surfaces of the base member 10130D have the side surface of the narrow-width portion NK disposed more inward and backward than the side surface of the wide-width portion WK and extending across the boundary between the narrow-width portion NK and the wide-width portion WK to the front side (side of the direction of the arrow F). On the left and right side surfaces, the wood member 142S is stuck to the left and right side surfaces of the wide-width portion WK, and the wood member 152M is stuck to the side surface of the narrow-width portion NK including the extending portion.

Therefore, the wood members 142S and 152M having substantially the same thickness dimension are stuck to the left and right side surfaces of the wide-width portion WK and the narrow-width portion NK. In addition, the wood member 152M is disposed across the boundary between the narrow-width portion NK and the wide-width portion WK on the left and right side surfaces of the narrow-width portion NK. In this case, a portion (i.e., portion that overlaps the wood member 142S as viewed in the direction of the arrow L-R) of the wood member 152M that is disposed across the boundary between the narrow-width portion NK and the wide-width portion WK has a thickness dimension smaller (thinner) than that of the rest of the wood member 152M.

Moreover, in the present embodiment, the wood member 142S has a thickness dimension smaller (thinner) than the thickness dimension of the wood member 141S but greater (thicker) than the thickness dimension of the wood member 152M. In addition, except that the thickness dimension of the portion of the wood member 152M that is disposed across the boundary between the narrow-width portion NK and the wide-width portion WK is set smaller (thinner), the wood member 152M has substantially the same thickness dimension as the wood member 151M.

In addition, in the present embodiment, the thickness dimension of the portion of the wood member 152M that is disposed across the boundary between the narrow-width portion NK and the wide-width portion WK is set equal to or greater (thicker) than the thickness dimension of the side plate 132 of the base member 10130D. Further, a pair of the wood members 152M is disposed on the left and right side surfaces (the sticking surface 132*a*) of the base member 10130D with their wood rear sides or wood surface sides facing each other.

A total of four wood members 142S, 151M and 153M are stuck to the left and right side surfaces (the sticking surface 132*a*) of the base members 10130G and 10130A of white keys 10101G and 10101A. Moreover, the white keys 10101G and 10101A are line-symmetrical with a virtual line along the direction of the arrow F-B as an axis of symmetry.

Specifically, one of the left and right side surfaces of the base members 10130G and 10130A has the side surface of the narrow-width portion NK disposed more inward and backward than the side surface of the wide-width portion WK. On such one side surface, the wood members 142S and 153M are disposed respectively on the wide-width portion WK and the narrow-width portion NK. The other of the above left and right side surfaces has the side surface of the narrow-width portion NK disposed more inward and backward than the side surface of the wide-width portion WK and extending across the boundary between the narrow-width portion NK and the wide-width portion WK to the front side (side of the direction of the arrow F). On such other side surface, the wood member 142S is stuck to the side surface of the wide-width portion WK, and the wood member 151M is stuck to the side surface of the narrow-width portion NK including the extending portion.

In this case, the thickness dimensions of the wood members 151M and 153M are set substantially the same. Therefore, the wood members 151M and 153M having substantially the same thickness dimension are stuck respectively to the left and right side surfaces of the narrow-width portion NK. In addition, the wood member 151M is disposed across the boundary between the narrow-width portion NK and the wide-width portion WK on the other side surface of the narrow-width portion NK. Moreover, the wood members 151M and 153M are disposed on the left and right side surfaces (the sticking surface 132*a*) of the base members 10130G, etc. with their wood rear sides or wood surface sides facing each other.

A total of three wood members 142S, 142L and 154M are stuck to the left and right side surfaces (the sticking surface 132*a*) of the base member 10130A' of a white key 10101A'.

Specifically, one of the left and right side surfaces of the base member 10130A' has the side surface of the wide-width portion WK disposed flush with the side surface of the narrow-width portion NK, and the wood member 142L is stuck to such one side surface. The other of the above left and right side surfaces has the side surface of the narrow-width portion NK disposed more inward and backward than the side surface of the wide-width portion WK and extending across the boundary between the narrow-width portion NK and the wide-width portion WK to the front side (side of the direction of the arrow F). On such other side surface, the wood member 142S is stuck to the side surface of the wide-width portion WK, and the wood member 154M is stuck to the side surface of the narrow-width portion NK including the extending portion.

In this case, the thickness dimensions of the wood members 142L and 154M are set substantially the same. Therefore, the wood members 142L and 154M having substantially the same thickness dimension are stuck respectively to the left and right side surfaces of the narrow-width portion NK. In addition, the wood member 151M is disposed across the boundary between the narrow-width portion NK and the wide-width portion WK on the other side surface of the narrow-width portion NK.

Moreover, a portion (i.e., portion that overlaps the wood member 142S as viewed in the direction of the arrow L-R) of the wood member 154M that is disposed across the boundary between the narrow-width portion NK and the wide-width portion WK has a thickness dimension smaller (thinner) than that of the rest of the wood member 154M. In the present embodiment, the thickness dimension of the portion of the wood member 154M that is disposed across the boundary between the narrow-width portion NK and the wide-width portion WK is set equal to or greater (thicker) than the thickness dimension of the side plate 132 of the base member 10130A'. In addition, in the present embodiment, the thickness dimensions of the wood members 142S and 142L are set substantially the same. The wood members 142L and 154M are disposed on the left and right side surfaces (the sticking surface 132*a*) of the base member 10130A' with their wood rear sides or wood surface sides facing each other.

As described above, according to the tenth embodiment, the white keys 10101C to 10101B and 10101A' have the wood members 141L, etc. respectively disposed on the left and right side surfaces of the narrow-width portion NK of their base members 10130C to 10130B and 10130A', wherein the thickness dimensions of the wood members 141L, etc. are set substantially the same. Accordingly, since rigidity of the white keys 10101C to 10101B and 10101A' can be made equal on left and right sides, the white keys 10101C to 10101B and 10101A' can be prevented from bending in a twisted manner when strongly tapped. As a result, interference between adjacent keys (the white keys 101 or the black keys 102) is reduced, and shaking of the keys during a performance can be prevented.

Here, for example, if the wood members 141L, etc. are disposed only on either surface (one or the other of the left and right side surfaces) of the narrow-width portion NK of the base members 10130C to 10130B and 10130A', leftward or rightward warpage easily occurs as a result of difference in expansion rate between the resin material and the wood material that arises when the temperature or the humidity varies. With respect to this, according to the present embodiment, since the thickness dimensions of the wood members 141L, etc. disposed on the left and right side surfaces of the narrow-width portion NK are set substantially the same, the impact of the warpage of the wood members is made uniform on the left and right sides, and the warpage of the key as a whole can be prevented.

In addition, in a structure of the base members 10130C to 10130B and 10130A' that includes the wide-width portion WK and the narrow-width portion NK, there is a risk that stress may concentrate at the boundary between the wide-width portion WK and the narrow-width portion NK. In this case, it can be considered to integrally form a rib that connects the upper plate 131 and the side plate 132 at the boundary between the wide-width portion WK and the narrow-width portion NK of the base members 10130C to 10130B and 10130A' to improve the rigidity, so as to prevent the stress concentration. However, when the rib is integrally formed with a thickness dimension sufficient to improve rigidity, a portion having a partially great (thick) thickness dimension is formed, and a sink mark occurs at the upper plate 131 and the side plate 132 during molding. Thus, the appearance of the upper surface (touching surface) and the side surface is spoiled. Meanwhile, a rib with a thickness dimension sufficient to prevent occurrence of a sink mark is not capable of sufficiently preventing the stress concentration.

With respect to this, according to the present embodiment, the side surface of the narrow-width portion NK disposed more inward and backward than the side surface of the wide-width portion WK extends across the boundary between the narrow-width portion NK and the wide-width portion WK to the front side (side of the direction of the arrow F), and the wood members 151M, 152M and 154M are disposed on the side surface of the narrow-width portion NK including the extending portion. Thus, a configuration can be formed in which the wood members 151M, 152M and 154M are disposed across the boundary between the narrow-width portion NK and the wide-width portion WK. Accordingly, stress at the boundary (i.e., portion where stress easily concentrates) between the narrow-width portion NK and the wide-width portion WK of the base members 10130C to 10130B and 10130A' can be effectively dispersed throughout the keys via the wood members 151M, 152M and 154M made of a wood material having higher rigidity than a resin material. As a result, deformation of or damage to the base members 10130C to 10130B and 10130A' when the keys are strongly tapped can be suppressed.

Particularly, in the present embodiment, even if a portion of the wood members 152M and 154M disposed across the boundary between the narrow-width portion NK and the wide-width portion WK has a small (thin) thickness dimension, the thickness dimension of such portion is set at least equal to or more than the thickness dimension of the side plate 132 of the base members 10130D and 10130A'. Thus, compared to the case where the rib is integrally formed, the rigidity can be reliably improved.

Figure 15A:
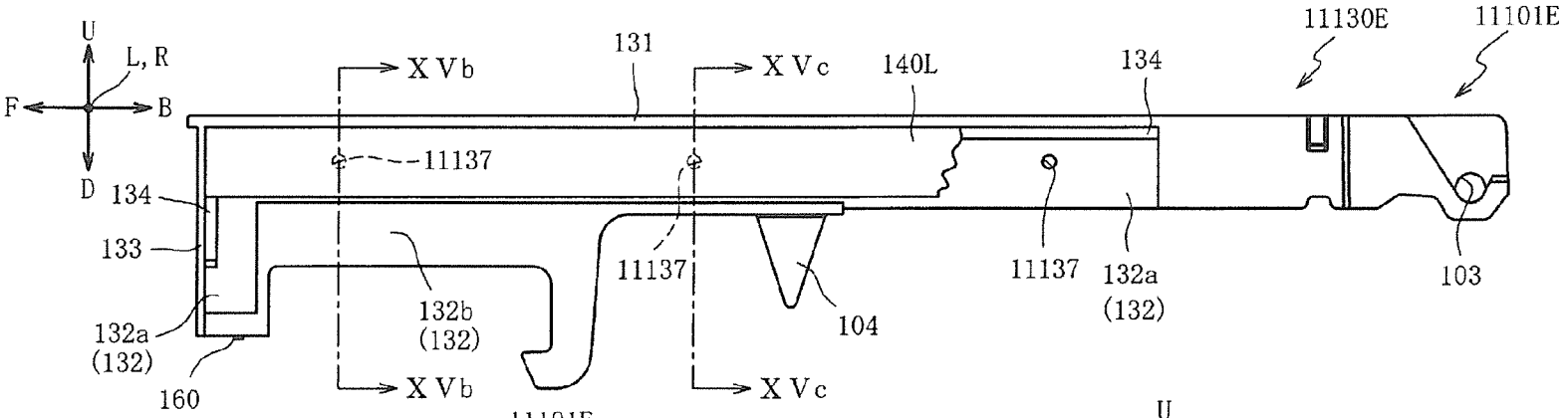
FIG. 15A is a side view of a white key according to the eleventh embodiment.
Figure 15C:
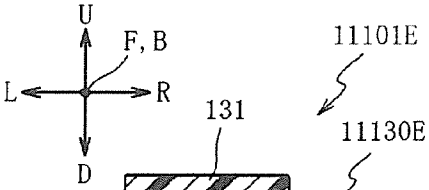
FIG. 15C is a cross-sectional view of the white key taken on line XVc-XVc in FIG. 15A.
Figure 15B:
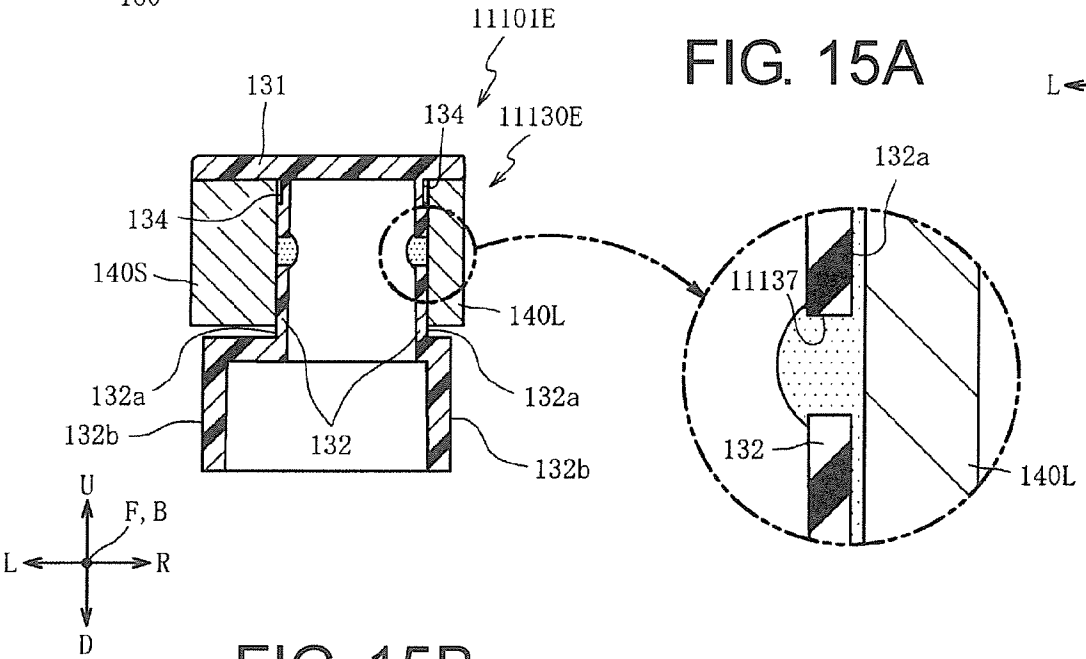
FIG. 15B is a cross-sectional view of the white key taken on line XVb-XVb in FIG. 15A.

Next, a keyboard device according to the eleventh embodiment is described with reference to FIGS. 15A to 15C. FIG. 15A is a side view of a white key 11101E according to the eleventh embodiment. FIG. 15B is a cross-sectional view of the white key 11101E taken on line XVb-XVb in FIG. 15A. FIG. 15C is a cross-sectional view of the white key 11101E taken on line XVc-XVc in FIG. 15A.

Moreover, in FIG. 15A, a longitudinal end portion of the wood member 140L is illustrated with a portion thereof omitted. In addition, in FIG. 15B, a ratio of the thickness dimension of the wood member 140L to the thickness dimension of the wood member 140S is schematically illustrated in an enlarged manner compared to the actual ratio.

The first embodiment has described a case where the concave groove 134 is depressed in the sticking surface 132*a* of the side plate 132 of the base members 130C to 130B, 130A' and 130C'. In the eleventh embodiment, the concave groove 134 is depressed in the sticking surface 132*a* of the side plate 132 of a base member 11130E, and in addition, a through hole 11137 is formed through the side plate 132. The same reference numerals denote the same portions as those in the above embodiments, and descriptions thereof are omitted.

Here, in the eleventh embodiment, the white key 11101E is described as a representative example of the configuration that the through hole 11137 is formed in a through manner. The white key 11101E has the same configuration as the white key 101E according to the first embodiment except that the through hole 11137 is formed through the side plate 132. Only the different portions are described hereinafter, and descriptions of the same portions are omitted.

As shown in FIGS. 15A to 15C, the through hole 11137 is formed through the side plate 132 of the base member 11130E along a thickness dimension (in the direction of the arrow L-R) thereof. The through hole 11137 is formed in a through manner as a hole circular in cross section, which is a portion that receives an adhesive interposed between the sticking surface 132*a* of the side plate 132 and the inside surface of the wood members 140L and 140S (between two adhered surfaces) and serves as a passage for the adhesive to go round to a back surface side (opposite side of the sticking surface 132*a*) of the side plate 132.

Moreover, in the present embodiment, in the side plate 132 on a side (right side in FIG. 15B) having the wood member 140L disposed thereon, the through hole 11137 is formed in a through manner at three different positions along a longitudinal direction of the base member 11130E. On the other hand, in the side plate 132 on a side (left side in FIG. 15B) having the wood member 140S disposed thereon, the through hole 11137 is formed in a through manner at one position.

In this manner, according to the white key 11101E, the through hole 11137 is formed in a through manner in a region (the sticking surface 132*a*) of the side plate 132 of the base member 11130E, wherein the region has the wood members 140L and 140S stuck thereon. Thus, when the wood members 140L and 140S are adhesively fixed to the sticking surface 132*a* of the side plate 132 by means of the adhesive, the adhesive interposed between the sticking surface 132*a* of the side plate 132 and the inside surface of the wood members 140L and 140S can flow (go round) to the back surface side (opposite side of the sticking surface 132*a*) of the side plate 132 via the through hole 11137. Accordingly, the adhesive that has gone round to the back surface side of the side plate 132 exhibits an anchor effect (see the enlarged portion in FIG. 15B), so that an adhesive strength of the wood members 140L and 140S with respect to the side plate 132 (the sticking surface 132*a*) can be improved.

In addition, as described above, the base member 11130E is formed in a box shape having an open lower surface (on the side of the direction of the arrow D). Thus, an outflow state of the adhesive flowing to the back surface side of the side plate 132 via the through hole 11137 can be visually recognized from the open portion on the lower surface side. Therefore, even when the wood members 140L and 140S have been adhesively fixed to the sticking surface 132*a* of the side plate 132, through visual recognition of the outflow state of the adhesive flowing from the through hole 11137, an applying state of the adhesive can be confirmed. As a result, adhesion failure can be detected.

Further, the through hole 11137 is formed in a through manner at a plurality of different positions along the longitudinal direction of the base member 11130E. Thus, when the adhesive is applied to a relatively long region (the sticking surface 132*a* or (and) the wood member 140L), even if applying failure that the adhesive is not applied to a portion of the region occurs, the applying failure can be easily detected.

The above illustrates the present invention on the basis of the embodiments. However, it is easily understood that the prevent invention is not limited to any of the above embodiments, and various modifications or alterations may be made without departing from the spirit of the present invention.

For example, the numerical values mentioned in the above embodiments are merely examples, and it is of course possible that other numerical values are used.

The above embodiments have described the cases where the wood members 140S, 140L, etc. are formed of spruce and the rigid members 150 and 9150 are formed of a medium density fiber board. However, the present invention is not limited thereto. The materials may be contrary to the above embodiments, or other wood materials different may be used. In addition, for example, when the wood members 140S and 140L are formed of a medium density fiber board or a plywood, in order to improve their appearance, a spruce veneer or a PVC (polyvinyl chloride) sheet having wood grain patterns may be stuck to an appearance surface (outside surface) of the wood members 140S and 140L.

The above embodiments have described the cases where a region of the sticking surface 132*a* that touches the wood members 140S, etc. is formed as a flat surface. However, the present invention is not limited thereto. Such region may also have one or more grooves depressed therein, or have one or more concavities or convexities formed thereon.

The above embodiments have described the cases where an adhesive is used as a means for fixing the wood members 140S, 140L, etc. and the rigid members 150, etc. However, the present invention is not limited thereto. A double-sided tape, for example, may also be used. In addition, if the wood members 140S, 140L, etc. or the rigid members 150, etc. are formed of a resin material, ultrasonic welding may also be used as a fixing means.

The above embodiments have described the cases where the rigid members 150 and 9150 are formed of a wood material and the rigid member 6150 is formed of a metal material. However, the present invention is not limited thereto. For example, the rigid members 150 and 9150 may be formed of a metal material or a resin material, and the rigid member 6150 may be formed of a wood material.

The above embodiments have described the cases where the wood members 140S and 140L are disposed respectively on the left and right side surfaces of the white keys 101A' and 101C'. However, the present invention is not limited thereto. The wood member 140L may also be omitted from one side surface (i.e., side surface adjacent to the end panel 2*c* of the panel portion 2; see FIGS. 1A and 1B) of the left and right side surfaces of the white keys 101A' and 101C'. In this case, due to the omission of the wood member 140L, the manufacturing costs can be reduced. In addition, by disposing the end panel 2*c* at a height sufficient to cover the one side surface, the one side surface can avoid being visually recognized by the player.

The above embodiments have described the case where the keyboard device 100 has 88 keys. However, this number is merely an example, and it is of course possible that the number of the keys is 89 or more or 87 or fewer. Therefore, the keys arranged at the left and right ends of the plurality of the keys lined up in the left-right direction are not necessarily the white keys 101A' and 101C' as in the above embodiments, but may be any of the other white keys 101C to 101B.

In the above embodiments, when the concave grooves 134 and 2134 are formed on the sticking surface 132*a*, the formation of the chamfered portions M3, etc. on the wood members 140S and 140L is omitted; when the chamfered portions M3 to M5 are formed on the wood members 3140S to 5140S, the formation of the concave grooves 134 and 2134 on the sticking surface 132*a* is omitted. However, the present invention is not limited thereto. It is of course possible that both the concave grooves 134 and 2134 and the chamfered portions M3 to M5 are respectively formed concurrently.

The above embodiments have described the cases where the rigid members 150 and 9150 are formed as rod-like bodies square in cross section. However, the present invention is not limited thereto. It is of course possible that the cross sections are in other shapes. The other shapes are exemplified by rectangle, polygon, square, circle, or ellipse, etc. Moreover, if the cross section is circular, directionality in the circumferential direction can be eliminated, so that workability in disposing the rigid members 150 and 9150 in the base members 130D and 9130D, etc. can be improved.

The above embodiments have described the cases where the rigid members 150, 6150 and 9150 are formed as rod-like or flat plate-like bodies having constant cross-sectional area (width dimension and thickness dimension) along the longitudinal direction. However, the present invention is not limited thereto. The rigid member may also be formed having a changing cross-sectional area along the longitudinal direction.

For example, the width dimension (dimension in the direction of the arrow L-R) of the rigid member may be increased as approaching the leading end side (side of the direction of the arrow F), such that the area of the rigid member that touches the upper plate 131 increases as approaching the leading end side. In this case, on the leading end side (the wide-width portion WK) of the white key 101 with a relatively large area being touched by the player's fingernail, the width dimension of the rigid member is increased so as to prevent occurrence of unpleasant noise. Meanwhile, on the base end side (the narrow-width portion NK) with a relatively small area being touched by the player's fingernail, the width dimension of the rigid member is reduced so as to reduce the product weight. Moreover, such width dimension may be continuously changing along the longitudinal direction, or may be different between the wide-width portion WK and the narrow-width portion NK.

The above eighth embodiment has described the case where the extension portion 8135*b*1 is disposed only at the protruding portion 8135*b* on the base end side (side of the direction of the arrow B). However, the present invention is not limited thereto. It is of course possible that the extension portion 8135*b*1 is also disposed at the protruding portion 135*a* on the leading end side (side of the direction of the arrow F). In this case, one end and the other end of the rigid member 150 are respectively engageable with the extension portions 8135*b*1 on the leading end side and the base end side. Thus, falling-off of the rigid member 150 can be more reliably prevented.

The above tenth embodiment has described the case where the portion of the wood members 152M and 154M that is disposed across the boundary between the narrow-width portion NK and the wide-width portion WK has a thickness dimension smaller (thinner) than that of the rest of the wood members 152M and 154M. However, the present invention is not limited thereto. In the wood member 151M, the portion disposed across the boundary between the narrow-width portion NK and the wide-width portion WK may also have a thickness dimension smaller (thinner) than that of the rest of the wood member 151M. Accordingly, when the wood member 151M is stuck to the sticking surface 132*a*, the wood member 151M can be easily disposed on the portion of the sticking surface 132*a* that extends across the boundary between the narrow-width portion NK and the wide-width portion WK to the front side (side of the direction of the arrow F) (inserted into a clearance between the sticking surface 132*a* and the back surface side of the sticking surface 132*a* of the wide-width portion WK). Meanwhile, since the wood member 151M is formed of a wood material having higher rigidity than a resin material, even if the thickness dimension is reduced (thinned), the effect due to improvement in rigidity can be sufficiently ensured.

The above eleventh embodiment has described the case where the through hole 11137 is formed in a through manner at three positions on the sticking surface 132*a* with the wood member 140L disposed thereon, and at one position on the sticking surface 132*a* with the wood member 140S disposed thereon. However, the present invention is not limited thereto. It is of course possible that the through hole 11137 is formed in a through manner at two or fewer positions or four or more positions on the sticking surface 132*a* with the wood member 140L disposed thereon, and at two or more positions on the sticking surface 132*a* with the wood member 140S disposed thereon. In this case, a plurality of the through holes 11137 are not necessarily lined up in one row, but may also be arranged in a zigzag manner or lined up in a plurality of rows.

The above eleventh embodiment has described the case where the through hole 11137 is disposed in the white key 101E according to the first embodiment as one example. However, the present invention is not limited thereto. It is of course possible that the through hole 11137 is disposed in another white key according to the first embodiment, such as the white key 101C, or in another white key according to another embodiment, such as the white key 10101C.

Here, as described above, the keyboard device 100 is formed in a manner that a mechanism that rotatably axially supports (supports) the white keys 101 and the black keys 102 by means of the chassis 110, a mechanism that guides rotation of the white keys 101 and the black keys 102, and a mechanism that rotates the hammer 120 along with pressing or release of the white keys 101 and the black keys 102 are substantially the same between both of the white keys 101 and the black keys 102. In this case, although the descriptions are omitted in the above embodiments, to change a key touch of each of predetermined key ranges as on a keyboard of an acoustic piano or to reduce difference in key touch (feel of torque) between the white keys 101 and the black keys 102, so as to enhance operability and feeling in playing, a means for making viscosity of a viscous material (lubricant such as grease, etc.) applied on a sliding portion different for each of predetermined key ranges or between the white keys 101 and the black keys 102 may be used.

Examples of the means for making the viscosity of the viscous material different include: a first means of causing the viscosity of a viscous material (lubricant such as grease, etc.) filled in the receiving portion 124 (see FIG. 2) of the white keys 101 to be higher than the viscosity of the viscous material applied on the receiving portion of the black keys 102; a second means of causing the viscosity of the viscous material applied on the receiving portion 124 of the white keys 101 to be lower than the viscosity of the viscous material filled in the receiving portion of the black keys 102; a third means of causing the viscosity of the viscous material applied on the cover member 161 (see FIG. 6B) of the white keys 101 to be higher than the viscosity of the viscous material applied on the cover member 161 of the black keys 102; a fourth means of causing the viscosity of the viscous material applied on the cover member 161 of the white keys 101 to be lower than the viscosity of the viscous material applied on the cover member 161 of the black keys 102; and a fifth means obtained by combining either the first means or the second means with either the third means or the fourth means.

What is claimed is:

1. A keyboard device, comprising a plurality of keys, wherein each of the plurality of keys comprises:

a base member formed of a resin material in a box shape having a touching surface, an open lower surface opposite the touching surface and left and right side surfaces, the base member having a rotatably supported base end side; and a pair of wood members formed of a wood material in a rectangular plate shape, disposed respectively on the left and right side surfaces of the base member, wherein at least one of the pair of wood members has a thickness dimension within a range of 2 mm or more and 14.5 mm or less.

2. The keyboard device of claim 1, wherein when the pair of wood members disposed on one and the other of the left and right side surfaces of the base member has different longitudinal dimensions between each other, one of the pair of wood members having a short longitudinal dimension has a thickness dimension greater than a thickness dimension of the other of the pair of wood members having a long longitudinal dimension.

3. The keyboard device of claim 1, wherein the base member comprises:

a wide-width portion, located on a front side in a longitudinal direction of the base member; and a narrow-width portion connected with the wide-width portion, located on the base end side in the longitudinal direction of the base member, the narrow-width portion having a smaller width dimension than the wide-width portion in a left-right direction of the base member, wherein the pair of wood members is disposed respectively on the left and right side surfaces of the narrow-width portion of the base member, and the pair of wood members disposed respectively on the left and right side surfaces of the narrow-width portion has substantially the same thickness dimension.

4. The keyboard device of claim 1, wherein the pair of wood members is disposed respectively on the left and right side surfaces of the base member with wood rear sides or wood surface sides of the pair of wood members facing each other.

5. The keyboard device of claim 1, wherein a concave groove is depressed in the left and right side surfaces of the base member in a region that comprises at least one of four sides corresponding to an outer edge of an inside surface of the pair of wood members that touches the left and right side surfaces of the base member.

6. The keyboard device of claim 5, wherein the concave groove of the base member is depressed in a region that comprises at least two of the four sides corresponding to the outer edge of the inside surface of the pair of wood members, wherein the at least two of the four sides comprise a side located on a touching surface side of the base member and a side located on a front side of the base member.

7. The keyboard device of claim 6, wherein the concave groove of the base member is depressed in at least one of: a region that comprises the side that is located on the touching surface side of the base member among the four sides corresponding to the outer edge of the inside surface of the pair of wood members, and a region that comprises the side that is located on the front side of the base member among the four sides corresponding to the outer edge of the inside surface of the pair of wood members, and the concave groove extends across the outer edge of the pair of wood members.

8. The keyboard device of claim 1, wherein the base member comprises side plates that form the left and right side surfaces, and a through hole is formed in the side plates where the pair of wood members is disposed.

9. The keyboard device of claim 1, wherein a plurality of through holes are formed through a region in the left and right side surfaces where the pair of wood members is disposed and the plurality of through holes are disposed at different positions in the longitudinal direction of the base member.

10. The keyboard device of claim 1, wherein a chamfered portion is formed on at least one of four sides of an outer edge of an inside surface of the pair of wood members that touches the left and right side surfaces of the base member by a chamfering process.

11. The keyboard device of claim 10, wherein the chamfered portion of the pair of wood members is formed on at least two of the four sides of the outer edge of the inside surface of the wood members, wherein the at least two of the four sides comprise a side corresponding to the touching surface side of the base member and a side corresponding to a front side of the base member.

12. The keyboard device of claim 1, wherein an outside surface of the pair of wood members is disposed flush with or more inward than left and right end surfaces of the touching surface of the base member, and a gap between the outside surface of the pair of wood members and the left and right end surfaces of the touching surface of the base member is within a range of 0 mm or more and 0.2 mm or less.

13. The keyboard device of claim 12, wherein a portion of the base member disposed lower than the pair of wood members is disposed more inward and backward than the outside surface of the pair of wood members.

14. The keyboard device of claim 1, wherein the base member comprises:

a wide-width portion, located on a front side in a longitudinal direction of the base member; and a narrow-width portion connected with the wide-width portion, located on the base end side in the longitudinal direction of the base member, the narrow-width portion having a smaller width dimension than the wide-width portion in a left-right direction of the base member, the plurality of keys comprise:

a first group of the keys, wherein one of the pair of wood members is disposed on the wide-width portion and the narrow-width portion of the base member, and the other one of the pair of wood members is disposed only on the wide-width portion of the base member; and a second group of the keys, wherein the pair of wood members is disposed only on the wide-width portion of the base member, wherein in at least the second group of the keys, a rigid member formed of a material having higher rigidity than the base member is disposed across a boundary between the wide-width portion and the narrow-width portion of the base member along a longitudinal direction of the base member.

15. The keyboard device of claim 14, wherein one end of the rigid member overlaps at least a portion of the pair of wood members disposed on the wide-width portion of the base member as viewed in a left-right direction of the base member among directions orthogonal to the longitudinal direction of the base member.

16. The keyboard device of claim 14, comprising a plurality of hammers, each of the plurality of hammers being rotated and displaced along with pressing or release of each of the plurality of keys respectively to apply an action load on each of the plurality of keys, wherein the base member comprises a hammer engaging portion projected from below the base member and capable of being engaged with the corresponding hammer, and the hammer engaging portion pushes down the corresponding hammer with the pressing of the corresponding key, wherein the other end of the rigid member overlaps at least a portion of the hammer engaging portion as viewed in a direction orthogonal to the longitudinal direction of the base member.

17. The keyboard device of claim 14, wherein the rigid member is disposed inside a cavity of the base member formed in the box shape having the open lower surface.

18. The keyboard device of claim 17, wherein the base member comprises an upper plate that forms the touching surface, the rigid member is disposed on a lower surface of the upper plate of the base member.

19. The keyboard device of claim 14, wherein the rigid member is formed of a wood material.

20. The keyboard device of claim 19, wherein the rigid member is disposed only in the second group of the keys among the first and second groups of the keys, thereby making the first and second groups of the keys have substantially the same weight.

21. The keyboard device of claim 17, wherein the rigid member is formed in a plate shape rectangular in cross section or in a rod shape circular in cross section as cut by a plane orthogonal to a longitudinal direction of the rigid member.

22. The keyboard device of claim 14, wherein the base member comprises an upper plate that forms the touching surface, the rigid member is formed of a metal material and buried in the upper plate.

23. The keyboard device of claim 18, wherein the base member comprises a pair of protruding portions projected from the lower surface of the upper plate and disposed opposed to each other with a predetermined spacing therebetween along the longitudinal direction of the base member, wherein the rigid member is disposed between the opposed pair of protruding portions.

24. The keyboard device of claim 23, wherein the pair of protruding portions of the base member is connected to left and right inner wall surfaces that define the cavity of the base member.

25. The keyboard device of claim 23, wherein at least one of the pair of protruding portions of the base member has a reduced cross-sectional area on a projected leading end side of the at least one of the pair of protruding portions in a cross section cut by a plane orthogonal to the left-right direction of the base member.

26. The keyboard device of claim 23, wherein at least one of the pair of protruding portions of the base member comprises an extension portion extending toward the other protruding portion while spaced from the lower surface of the upper plate to allow the rigid member to be interposed therebetween.

27. The keyboard device of claim 23, wherein at least one of the pair of protruding portions of the base member comprises a recess portion formed on a projected leading end of the at least one of the pair of protruding portions, the recess portion being recessed in a V shape as viewed in the longitudinal direction of the base member, the V shape being larger than a width dimension of the rigid member in a left-right direction of the rigid member.

28. The keyboard device of claim 23, wherein the base member comprises opposed walls projected from the lower surface of the upper plate and disposed opposed to each other with a predetermined spacing therebetween along the left-right direction of the base member, wherein the rigid member is disposed between the opposed walls.

29. The keyboard device of claim 1, wherein the base member comprises:

a wide-width portion, located on a front side in a longitudinal direction of the base member; and a narrow-width portion connected with the wide-width portion, located on the base end side in the longitudinal direction of the base member, the narrow-width portion having a smaller width dimension than the wide-width portion in a left-right direction of the base member, wherein at least one of the left and right side surfaces of the narrow-width portion extends across a boundary between the narrow-width portion and the wide-width portion, and at least one of the pair of wood members is disposed across the boundary between the narrow-width portion and the wide-width portion by being disposed on one of the left and right side surfaces of the narrow-width portion.

* * * * *